US010479078B2

(12) United States Patent
Fukuda et al.

(10) Patent No.: US 10,479,078 B2
(45) Date of Patent: Nov. 19, 2019

(54) LIQUID EJECTING HEAD, LIQUID EJECTING APPARATUS, AND MANUFACTURING METHOD OF LIQUID EJECTING APPARATUS

(71) Applicant: SEIKO EPSON CORPORATION, Tokyo (JP)

(72) Inventors: Shunya Fukuda, Azumino (JP); Motoki Takabe, Shiojiri (JP); Eiju Hirai, Azumino (JP); Akira Miyagishi, Matsumoto (JP); Hajime Nakao, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/410,270

(22) Filed: Jan. 19, 2017

(65) Prior Publication Data

US 2017/0217179 A1 Aug. 3, 2017

(30) Foreign Application Priority Data

Jan. 29, 2016 (JP) ..... 2016-016284

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1626* (2013.01); *B41J 2002/14306* (2013.01); *B41J 2002/14419* (2013.01)

(58) Field of Classification Search
CPC .... B41J 2/1623; B41J 2/14233; B41J 2/1433; B41J 2/14; B41J 2/1626; B41J 2/16;
(Continued)

(56) References Cited

U.S. PATENT DOCUMENTS

2003/0156158 A1 8/2003 Hirota et al.
2003/0156159 A1 8/2003 Kobayashi
(Continued)

FOREIGN PATENT DOCUMENTS

EP 2 594 401 A1 5/2013
EP 2 990 207 A1 3/2016
(Continued)

OTHER PUBLICATIONS

Extended European Search Report dated Jul. 6, 2017 in related European Appl. 17153187.4 (8 pgs.).

*Primary Examiner* — Jannelle M Lebron
(74) *Attorney, Agent, or Firm* — Foley & Lardner LLP

(57) ABSTRACT

A flow path forming substrate in which an individual flow path which communicates with a nozzle opening that discharges liquid is formed; and a communication plate in which a recess portion which configures at least a part of a common flow path that is common to and communicates with the plurality of individual flow paths is provided to be open on a side opposite to the flow path forming substrate, are provided, the recess portion includes a first recess portion, and a second recess portion which is deeper than the first recess portion, the communication plate includes a supply path which is provided to be open on a bottom surface of the first recess portion, communicates with the recess portion and the individual flow path, and becomes a throttle portion that throttles a flow path with respect to the individual flow path, and a communication path which communicates with the individual flow path and the nozzle opening, and in the individual flow path, a throttle portion which throttles the individual flow path from a part that communicates with the supply path to a part that communicates with the communication path, is not provided.

18 Claims, 20 Drawing Sheets

(58) Field of Classification Search
CPC ..... B41J 2002/14306; B41J 2/161; B41J 2002/14419
USPC ..... 347/20, 54, 68, 71, 85
See application file for complete search history.

(56) References Cited

U.S. PATENT DOCUMENTS

| | | | | |
|---|---|---|---|---|
| 2003/0156162 | A1 | 8/2003 | Hirota et al. | |
| 2011/0205313 | A1 | 8/2011 | Kim et al. | |
| 2013/0127956 | A1* | 5/2013 | Watanabe | B41J 2/14233 347/71 |
| 2014/0362142 | A1 | 12/2014 | Takaai et al. | |
| 2015/0202875 | A1 | 7/2015 | Watanabe et al. | |

FOREIGN PATENT DOCUMENTS

| | | | |
|---|---|---|---|
| JP | 2003-311952 | A | 11/2003 |
| JP | 2008-018642 | A | 1/2008 |
| JP | 2009-255316 | A | 11/2009 |
| JP | 2014-037133 | A | 2/2014 |
| JP | 2015-112803 | A | 6/2015 |
| WO | WO-97/34769 | A1 | 9/1997 |

* cited by examiner

LIQUID EJECTING HEAD, LIQUID EJECTING APPARATUS, AND MANUFACTURING METHOD OF LIQUID EJECTING APPARATUS

BACKGROUND

1. Technical Field

The present invention relates to a liquid ejecting head which discharge liquid from a nozzle opening, a liquid ejecting apparatus, and a manufacturing method of the liquid ejecting apparatus, particularly to an ink jet type recording head which discharges ink which is the liquid, an ink jet type recording device, and a manufacturing method of the ink jet type recording device.

2. Related Art

As an ink jet type recording head which is a representative example of a liquid ejecting head which ejects liquid droplets, for example, there is a liquid ejecting head which is provided with a nozzle opening and a pressure generation chamber that communicates with the nozzle opening, and which discharges ink droplets from the nozzle opening by generating a pressure change in ink on the inside of the pressure generation chamber by a pressure generation unit.

In the ink jet type recording head, a configuration in which a pressure generation chamber and a supply path which is a throttle portion of a flow path that supplies ink of a manifold to the pressure generation chamber, are provided in a flow path forming substrate, is disclosed (for example, refer to JP-A-2008-018642).

In addition, in the ink jet type recording head, a configuration in which a pressure chamber forming substrate in which a plurality of pressure generation chambers are formed, and a communication substrate in which a recess portion which configures at least a part of a common flow path (which is also referred to as a manifold) that is in common to and communicates with the plurality of pressure generation chambers is formed, are layered, the recess portion is provided on a side opposite to the pressure chamber forming substrate of the communication substrate, and a supply path which communicates with the recess portion and each pressure generation chamber are provided to penetrate along the layering direction in the communication substrate, is suggested (for example, refer to JP-A-2014-037133).

However, a sectional area (hole diameter) of the flow path or the flow path length of the supply path should be appropriately set since flow path resistance largely influences discharge characteristics of the ink, but similar to JP-A-2008-018642, in a configuration in which the supply path is provided on the flow path forming substrate, there is a problem that the size of the flow path forming substrate becomes large due to the supply path.

In addition, similar to JP-A-2014-037133, in the configuration in which the supply path is provided in the communication plate, when the flow path length is appropriately set, the depth of the recess portion which configures a part of the manifold decreases, and there is a problem that the flow path resistance in the recess portion increases. Meanwhile, when the recess portion is formed to be deep, there is a problem that the flow path length of the supply path is not sufficient, and the supply path cannot be formed to have an appropriate flow path length.

In addition, the problems also similarly remain in the liquid ejecting head which ejects the liquid other than the ink, not being limited to the ink jet type recording head.

SUMMARY

An advantage of some aspects of the invention is to provide a liquid ejecting head which can ensure a depth of a recess portion and a necessary length of a supply path, and can reduce the size, a liquid ejecting apparatus, and a manufacturing method of the liquid ejecting apparatus.

According to an aspect of the invention, there is provided a liquid ejecting head including: a flow path forming substrate in which an individual flow path which communicates with a nozzle opening that discharges liquid is formed; and a communication plate in which a recess portion which configures at least a part of a common flow path that is common to and communicates with the plurality of individual flow paths is provided to be open on a side opposite to the flow path forming substrate, in which the recess portion includes a first recess portion, and a second recess portion which is deeper than the first recess portion, in which the communication plate includes a supply path which is provided to be open on a bottom surface of the first recess portion, communicates with the recess portion and the individual flow path, and becomes a throttle portion that throttles a flow path with respect to the individual flow path, and a communication path which communicates with the individual flow path and the nozzle opening, and in which, in the individual flow path, a throttle portion which throttles the individual flow path from a part that communicates with the supply path to a part that communicates with the communication path, is not provided.

In the aspect, by opening the supply path to the bottom surface of the first recess portion, it is possible to improve discharge efficiency by ensuring the length of the supply path and by reducing pressure loss. Furthermore, by providing the second recess portion, it is possible to ensure a volume of manifold, and to reduce the size. In addition, as the throttle portion is not provided on the flow path forming substrate, it is possible to prevent an increase in size of the flow path forming substrate, and to reduce the size. In addition, by providing the supply path and the communication path on the communication plate, it is possible to prevent unevenness of discharge characteristics of the liquid caused by a position shift between the supply path and the communication path.

In the liquid ejecting head, it is preferable that the communication path and the supply path be formed by performing anisotropic etching from one surface side of the communication plate. According to this, it is possible to further prevent the relative positional shift between the communication path and the supply path.

In the liquid ejecting head, it is preferable that the communication plate be made of one substrate. According to this, compared to a case where the layered substrate is used, it is possible to prevent a decrease in accuracy caused by positional shift of the layered substrate.

In the liquid ejecting head, it is preferable that the communication plate be made by layering a plurality of substrates. According to this, it is possible to easily perform processing by the etching or the like.

In the liquid ejecting head, it is preferable that an inclined surface which is inclined toward a bottom surface of the second recess portion from a bottom surface of the first recess portion be formed between the first recess portion and the second recess portion. According to this, by providing the inclined surface, it is possible to prevent stagnation of a flow of the liquid, and to improve bubble discharge characteristics.

In the liquid ejecting head, it is preferable that the communication plate be a silicon substrate which becomes a plane in which a crystal plane orientation of a front surface is a {110} plane, and the bottom surfaces of the first recess portion and the second recess portion be formed of a plane in which a crystal plane orientation is a {110} plane. According to this, by performing precise processing by the anisotropic etching, it is possible to form highly precise first recess portion and second recess portion. In addition, by opening the supply path to the bottom surface of the first recess portion which becomes the {110} plane, it is possible to improve processing accuracy, and to improve shape stability.

According to another aspect of the invention, there is provided a liquid ejecting apparatus including: the liquid ejecting head according to the above-described aspect.

In the aspect, it is possible to improve discharge efficiency by reducing pressure loss, and to realize a small liquid ejecting apparatus.

According to still another aspect of the invention, there is provided a manufacturing method of a liquid ejecting head which includes a flow path forming substrate in which an individual flow path which communicates with a nozzle opening that discharges liquid is formed; and a communication plate in which a recess portion which configures at least a part of a common flow path that is common to and communicates with the plurality of individual flow paths is provided to be open on a side opposite to the flow path forming substrate, in which the recess portion includes a first recess portion, and a second recess portion which is deeper than the first recess portion, in which the communication plate includes a supply path which is provided to be open on a bottom surface of the first recess portion, communicates with the recess portion and the individual flow path, and becomes a throttle portion that throttles a flow path with respect to the individual flow path, and a communication path which communicates with the individual flow path and the nozzle opening, and in which, in the individual flow path, a throttle portion which throttles the individual flow path from a part that communicates with the supply path to a part that communicates with the communication path, is not provided, the method including: forming the communication path and the supply path by performing anisotropic etching from one surface side which is opposite to a surface on which the recess portion of the communication plate is open.

In the aspect, by providing the supply path and the communication path on the communication plate, it is possible to prevent unevenness of the discharge characteristics of the liquid caused by a position shift between the supply path and the communication path. In addition, by forming the communication path and the supply path from one surface side of the communication plate, it is possible to further prevent a relative position shift between the communication plate and the supply path.

In the manufacturing method of a liquid ejecting head, it is preferable that the same mask be used in forming the communication path and the supply path on the communication plate. According to this, by forming the communication path and the supply path by using the same mask, it is possible to further prevent the relative position shift between the communication path and the supply path compared to a case where different masks are used.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on the embodiments.

Embodiment 1

Figure 1:
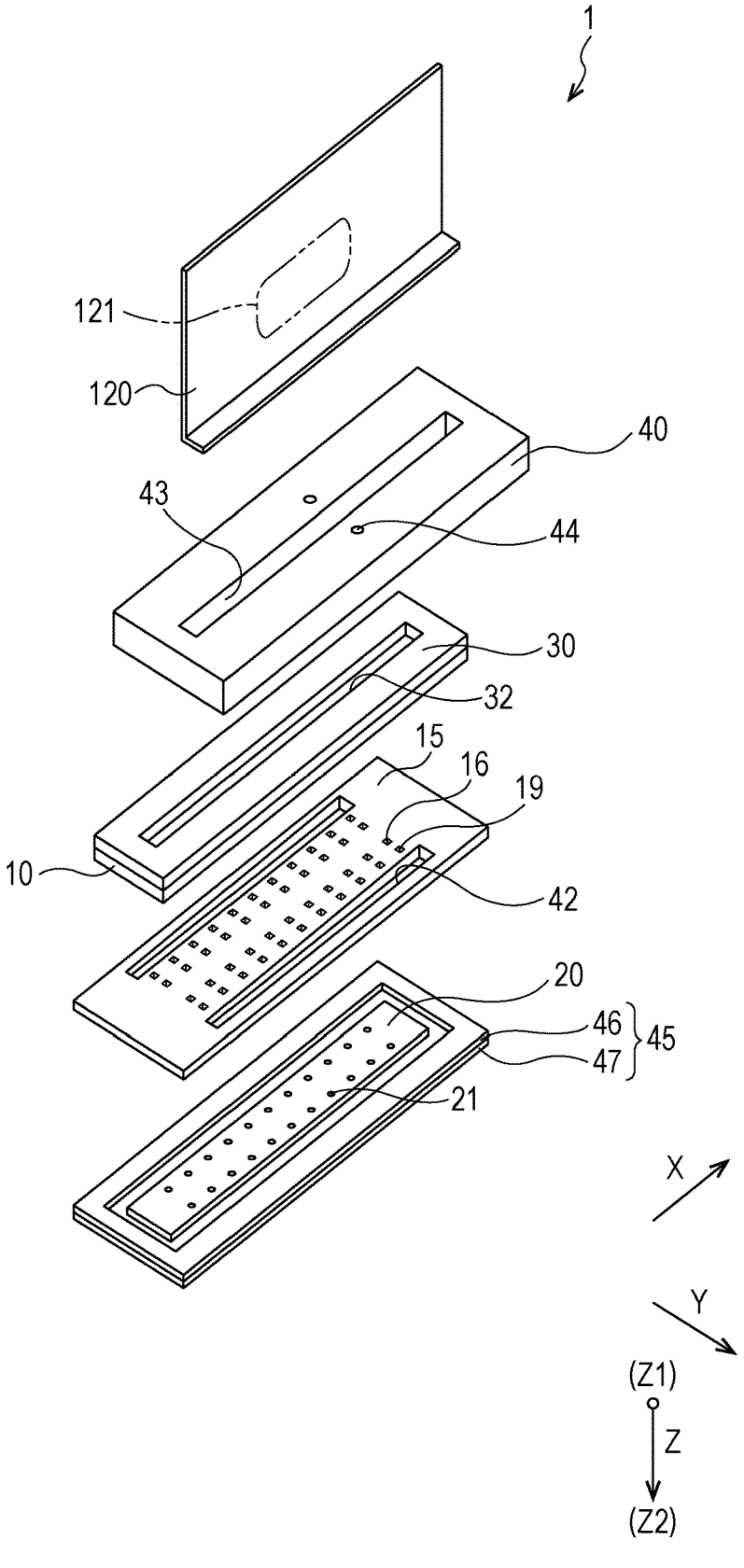
FIG. 1 is an exploded perspective view of a recording head according to Embodiment 1 of the invention.
Figure 2:
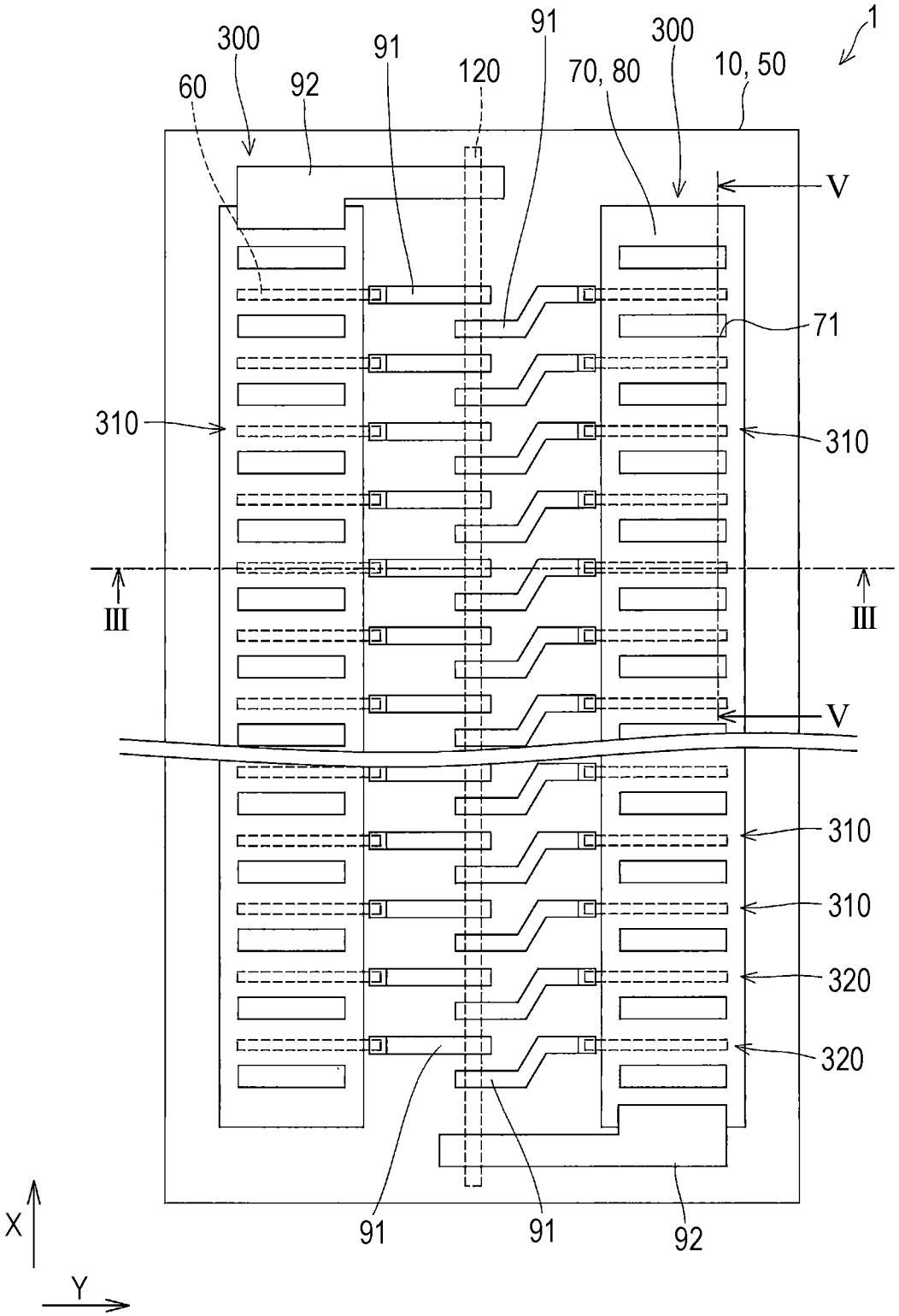
FIG. 2 is a plan view of a flow path forming substrate according to Embodiment 1 of the invention.
Figure 3:
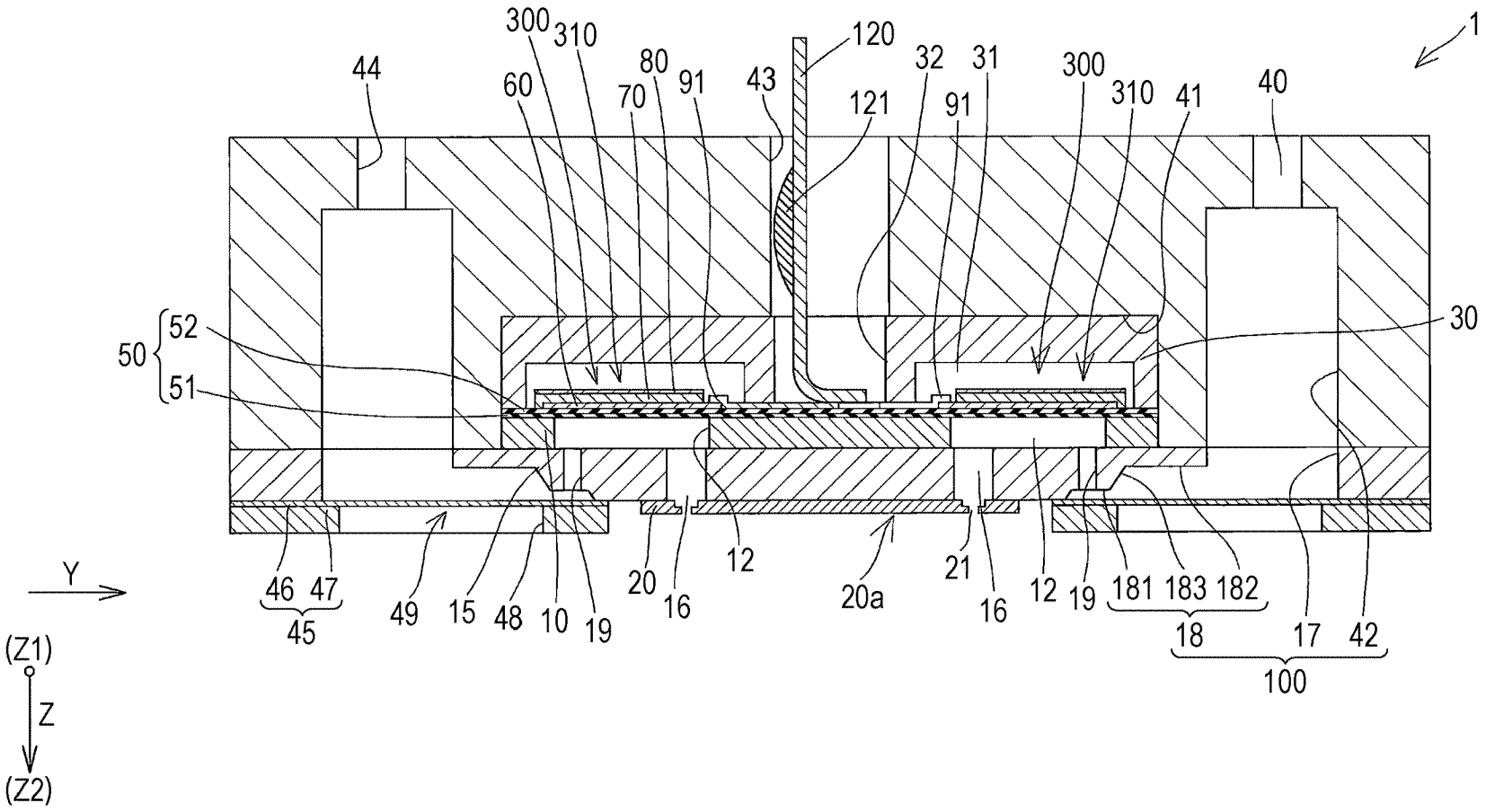
FIG. 3 is a sectional view of the recording head according to Embodiment 1 of the invention.
Figure 4:
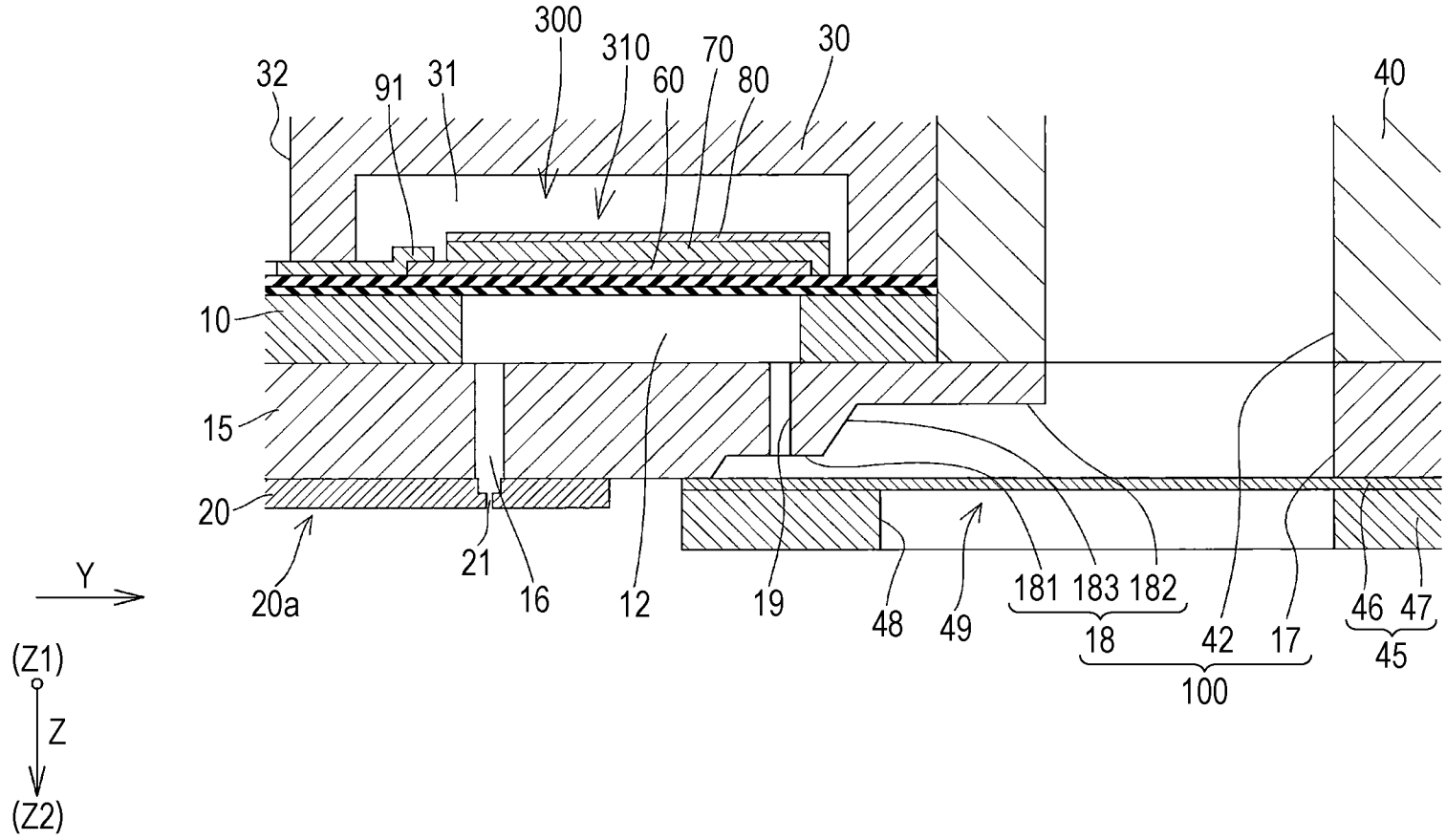
FIG. 4 is a sectional view in which main portions of the recording head according to Embodiment 1 of the invention are enlarged.
Figure 5:
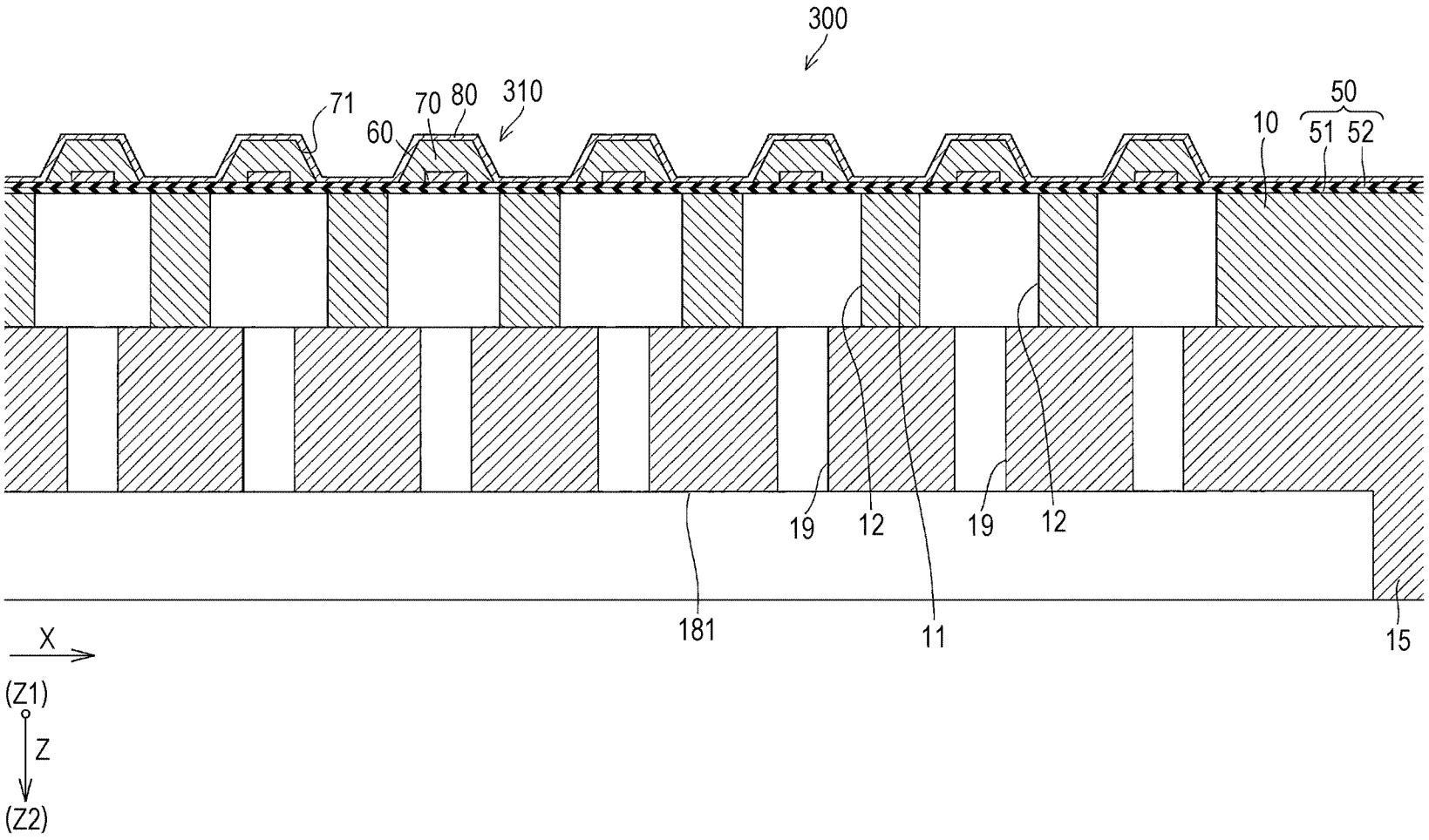
FIG. 5 is a sectional view in which the main portions of the recording head according to Embodiment 1 of the invention are enlarged.
Figure 6:
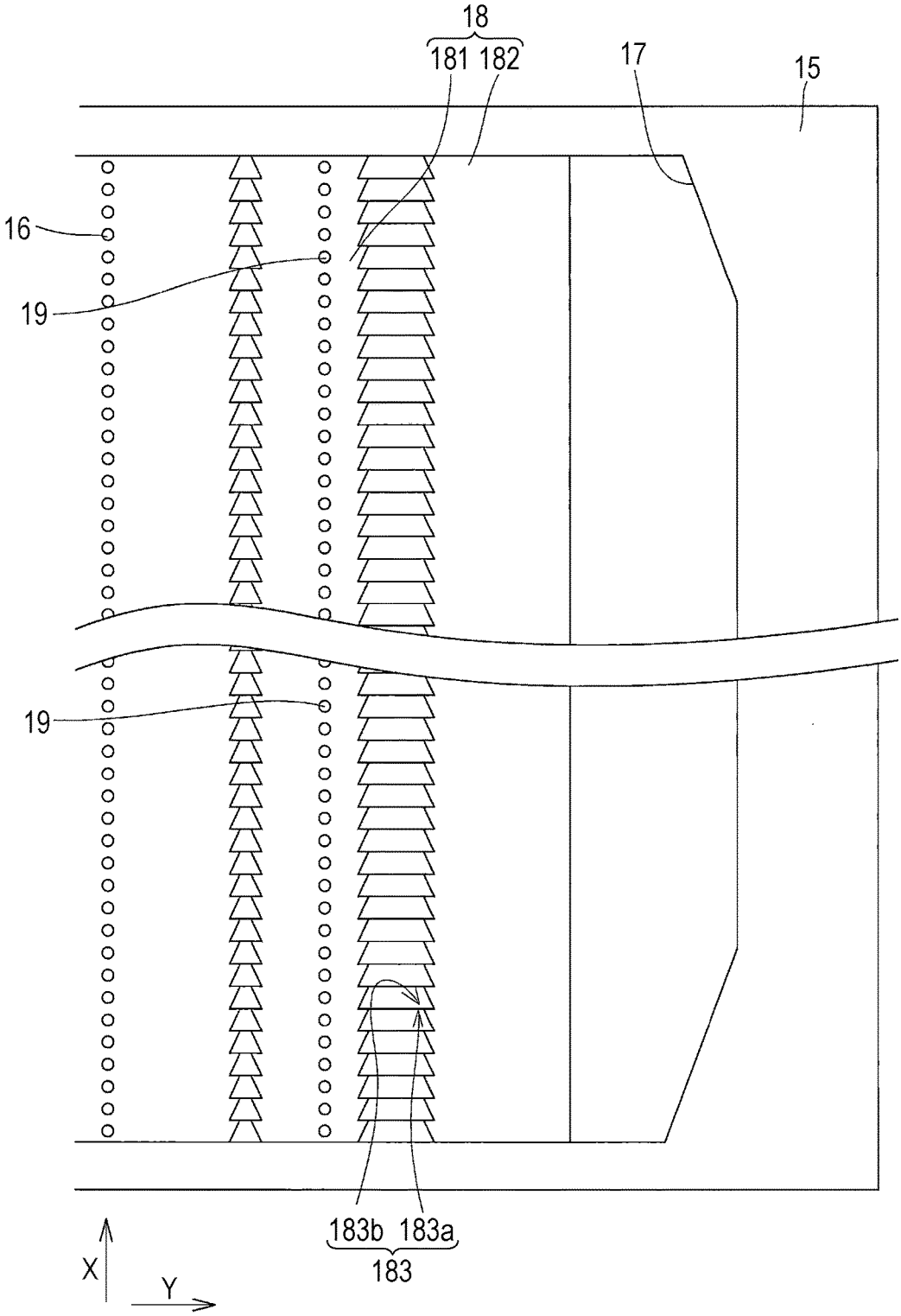
FIG. 6 is a plan view of a communication plate according to Embodiment 1 of the invention.
Figure 7:
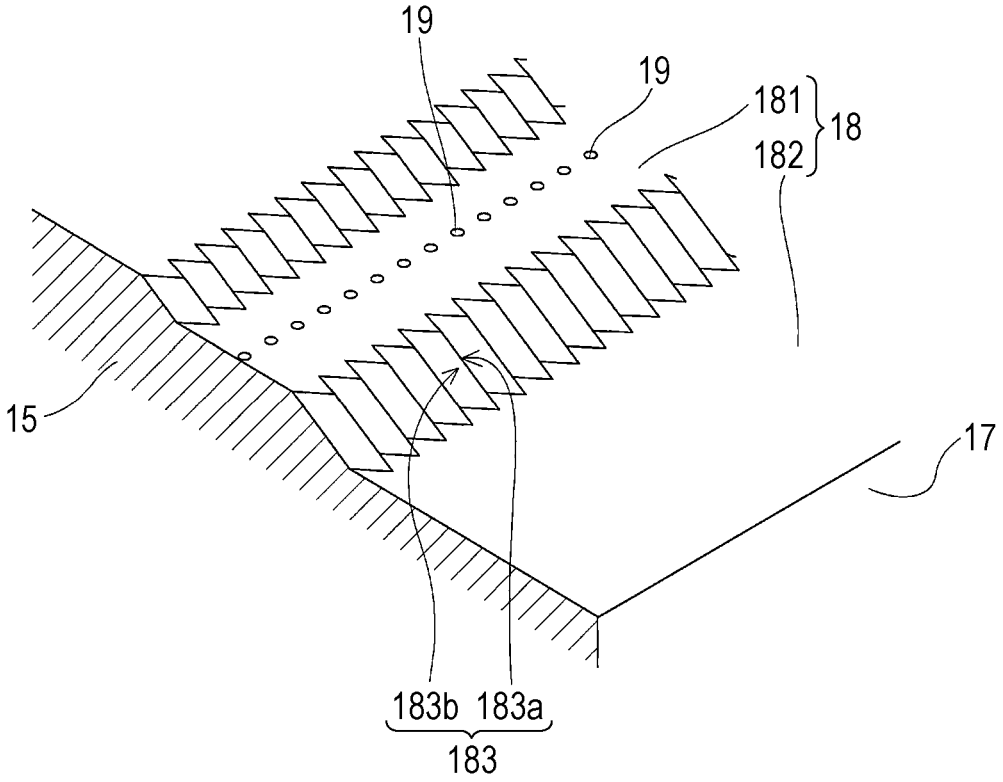
FIG. 7 is a perspective view in which main portions of the communication plate according to Embodiment 1 of the invention are cut out.

FIG. 1 is an exploded perspective view of an ink jet type recording head which is a liquid ejecting head according to Embodiment 1 of the invention, FIG. 2 is a plan view of main portions of a flow path forming substrate of a recording head, FIG. 3 is a sectional view taken along the line III-III in FIG. 2, FIG. 4 is a sectional view in which main portions of FIG. 3 are enlarged, FIG. 5 is a sectional view taken along the line V-V in FIG. 2, FIG. 6 is a plan view of a communication plate, and FIG. 7 is a perspective view in which main portions of the communication plate are cut out.

As illustrated in the drawings, in a flow path forming substrate 10 which configures an ink jet type recording head 1 (hereinafter, also simply referred to as a recording head 1) of the embodiment, by performing anisotropic etching from one surface side, pressure generation chambers 12 which are individual flow paths of the embodiment divided by a plurality of partition walls 11, are arranged along the direction in which a plurality of nozzle openings 21 which discharge ink are arranged. Hereinafter, the direction is referred to as the arranging direction of the pressure generation chamber 12, or a first direction X. In addition, in the flow path forming substrate 10, the number of rows in which the pressure generation chambers 12 are arranged in the first direction X is plural, and in the embodiment, the number of rows is two. An arranging direction in which the plurality of rows of pressure generation chambers 12 are arrayed is referred to as a second direction Y hereinafter. Furthermore, a direction orthogonal to both of the first direction X and the second direction Y is referred to as a third direction Z. Specifically, a case member 40 side which will be described later is referred to as a Z1 side, and a nozzle plate 20 side is referred to as a Z2 side. In addition, the first direction X, the second direction Y, and the third direction Z are directions which are orthogonal to each other, but not being particularly limited thereto, the directions may be directions which intersect each other by an angle other than an orthogonal angle.

In addition, in the embodiment, each pressure generation chamber 12 which is each individual flow path, is formed so that sectional areas which cross in the first direction X throughout the second direction Y have substantially the same size. In other words, in the pressure generation chamber 12, the width in the first direction X and the depth in the third direction Z are substantially the same throughout the second direction Y.

On a surface side on the Z2 side of the flow path forming substrate 10, a communication plate 15 and the nozzle plate 20 are layered in order.

In the communication plate 15, as illustrated in FIGS. 3 and 4, a communication path 16 which communicates with the pressure generation chamber 12 and the nozzle opening 21 is provided. The communication plate 15 has an area greater than the flow path forming substrate 10, and the nozzle plate 20 has an area smaller than the flow path forming substrate 10. In this manner, in order to separate the nozzle opening 21 of the nozzle plate 20 and the pressure generation chamber 12 from each other by providing the communication plate 15, the ink which is in the pressure generation chamber 12 is unlikely to receive influence of evaporation of moisture in the ink generated in the ink in the vicinity of the nozzle opening 21. In addition, since the nozzle plate 20 may only cover the opening of the communication path 16 which communicates with the pressure generation chamber 12 and the nozzle opening 21, it is possible to relatively reduce the area of the nozzle plate 20, and to achieve reduction of costs. In addition, in the embodiment, the nozzle opening 21 of the nozzle plate 20 is open, and a surface on which ink droplets are discharged is referred to as a liquid ejecting surface 20*a*.

In addition, in the communication plate 15, a first manifold portion 17 which configures a part of a manifold 100 that is a common flow path which is common to and communicates with the pressure generation chambers 12 that are the plurality of individual flow paths, and a second manifold portion 18 which is a recess portion of the embodiment, are provided.

The first manifold portion 17 is provided to penetrate the communication plate 15 in the third direction Z.

In addition, the second manifold portion 18 becomes a recess portion provided to be open on the nozzle plate 20 side of the communication plate 15 without penetrating the communication plate 15 in the third direction Z.

Here, as illustrated in FIGS. 4 to 7, the second manifold portion 18 includes a first recess portion 181 which is open to a surface on the Z2 side opposite to the flow path forming substrate 10, and a second recess portion 182 which is open to the surface on the Z2 side, and is deeper than the first recess portion 181. The first recess portion 181 and the second recess portion 182 are formed to be arranged in the second direction Y, and the first recess portion 181 is disposed on a side opposite to the first manifold portion 17 of the second recess portion 182.

The first recess portion 181 and the second recess portion 182 are formed in a shape of steps due to a difference in depth in the third direction Z. In other words, when viewed from the second recess portion 182, the first recess portion 181 is formed at a part in a shape of a platform which is elevated to the Z2 side. In addition, between the first recess portion 181 and the second recess portion 182, an inclined surface 183 which is inclined toward a bottom surface of the first recess portion 181 from a bottom surface of the second recess portion 182, is provided. The inclined surface 183 is provided to be inclined with respect to the third direction Z, and the inclination direction of the inclined surface 183 is the direction toward the bottom surface of the first recess portion 181 from the bottom surface of the second recess portion 182, that is, the direction in which the width of the second recess portion 182 in the second direction Y gradually increases. In addition, the bottom surface of the first recess portion 181 and the bottom surface of the second recess portion 182 are surfaces on each Z1 side of the first recess portion 181 and the second recess portion 182. In the embodiment, the bottom surface of the first recess portion 181 and the bottom surface of the second recess portion 182 are flat surfaces including the first direction X and the second direction Y, and but not being particularly limited thereto, for example, the bottom surface of the first recess portion 181 and the bottom surface of the second recess portion 182 may be surfaces which are inclined with respect to the direction orthogonal to the third direction Z.

In addition, the inclined surface 183 is formed by alternately arranging a first inclined surface 183*a* and a second inclined surface 183*b* which have different angles to the first direction X. In other words, by arranging the first inclined surface 183*a* and the second inclined surface 183*b* which have different angles to be alternately repeated, the inclined surface 183 is formed.

Here, in the embodiment, the communication plate 15 is made of a silicon substrate (silicon single crystal substrate) of a plane in which a crystal plane orientation of a front surface is a {110} plane. In addition, at least the second manifold portion 18 is formed by performing anisotropic etching (wet etching) in which an alkaline solution, such as KOH, is used from a surface on the Z1 side, with respect to the communication plate 15. The anisotropic etching is performed by using a difference in etching rate of the silicon single crystal substrate. In the embodiment, since the silicon single crystal substrate in which the surface orientation of the surfaces on the Z1 side and the Z2 side of the communication plate 15 is a {110} plane is used, compared to an etching rate on the {110} plane of the silicon single crystal substrate, the anisotropic etching is performed by using properties that the etching rate of a {111} plane is approximately 1/180. In other words, when the silicon single crystal substrate is immersed in the alkaline solution, a first {111} plane which is perpendicular to the {110} plane that gradually erodes, a second {111} plane which makes an angle of approximately 70 degrees with the first {111} plane, and is perpendicular to the above-described {110} plane, and a third {111} plane which makes an angle of approximately 35 degrees with the above-described {110} plane, and makes an angle of 54.74 degrees with the first {111} plane, appear. In the embodiment, the bottom surface of the first recess portion 181 and the bottom surface of the second recess portion 182 are formed on the {110} plane. In addition, in the embodiment, the first inclined surface 183*a* which configures the inclined surface 183 is formed on an arbitrary (high etching rate) surface, and the second inclined surface 183*b* is formed on the third {111} plane. In other words, the inclined surface 183 is formed as the first inclined surface 183*a* and the second inclined surface 183*b* which have different angles are alternately arranged in the first direction X.

In addition, in the communication plate 15, a supply path 19 which communicates with one end portion in the second direction Y of the pressure generation chamber 12 is independently provided in accordance with each of the pressure generation chambers 12. The supply path 19 communicates with the second manifold portion 18 and the pressure generation chamber 12. In the embodiment, the supply path 19 is provided to be open to the {110} plane which is the bottom surface of the first recess portion 181. In addition, the supply paths 19 are arranged in the first direction X which is the arranging direction of the pressure generation chambers 12. Here, the supply path 19 functions as a throttle portion which throttles a flow path with respect to the pressure generation chamber 12 and the manifold 100. In addition, the throttle portion of the invention is a part which widens again after the area which crosses the direction is narrowed from a wide part, in the direction in which the liquid of the flow path flows. In other words, the throttle portion is a part which increases after at least a part of the width and the depth decreases with respect to the direction in which the ink flows. Meanwhile, a part which remains in a state where at least a part of the width and the depth of the flow path is reduced, or a part which remains in a state where at least a part of the width and the depth of the flow path is increased, are not throttle portion. In the embodiment, the cross-sectional area of the supply path 19 is smaller than the cross-sectional area of the pressure generation chamber 12. Therefore, the supply path 19 functions as the throttle portion which throttles the flow path from the manifold 100 to the pressure generation chamber 12.

Meanwhile, in the flow path forming substrate 10, in the embodiment, only the pressure generation chamber 12 is formed and the throttle portion which throttles the flow path is not formed. In other words, in the embodiment, since the width in the first direction X and the depth in the third direction Z in the pressure generation chamber 12 are substantially the same throughout the second direction Y, in the flow path forming substrate 10, the flow path which increases is not formed after being reduced from a part which considers the cross-sectional area of the flow path as a reference. In addition, the shape of the pressure generation chamber 12 is not particularly limited thereto, and for example, in a plan view from the third direction Z, the shape may be a circular shape, an elliptical shape, or a trapezoidal shape. Meanwhile, in a case where the shape of the pressure generation chamber 12 is a trapezoidal shape, the supply path 19 side may be an upper bottom, or may be a lower bottom side. In any case, in a plan view, in a case where the shape of the pressure generation chamber 12 is a circular shape, an elliptical shape, or a trapezoidal shape, from the part which communicates with the supply path 19 of the flow path which is the pressure generation chamber 12 to the part which communicates with the communication path 16, after the cross-sectional area is reduced, a part which increases, that is, the throttle portion is not provided.

In this manner, without providing the supply path 19 which becomes the throttle portion on the flow path forming substrate 10, by providing the supply path 19 on the communication plate 15, it is possible to achieve a small size of the flow path forming substrate 10. In other words, in a case where the pressure generation chamber 12 and the supply path 19 are provided on the flow path forming substrate 10, a space for providing the supply path 19 becomes necessary, and the size is enlarged, but in the embodiment, since the pressure generation chamber 12 is provided on the flow path forming substrate 10, and the supply path 19 or the like which is the throttle portion is not provided, it is possible to achieve a small size of the flow path forming substrate 10, and to reduce the costs.

In addition, by providing the communication path 16 and the supply path 19 on the communication plate 15, compared to a case where the supply path which is the throttle portion is provided on the flow path forming substrate 10, it is possible to prevent a position shift between the communication path 16 and the supply path 19. Meanwhile, in a case where the supply path is provided on the flow path forming substrate 10, since positioning accuracy of the communication plate 15 and the flow path forming substrate 10 largely influences relative positions of the communication path 16 provided on the communication plate 15 and the supply path provided on the flow path forming substrate 10, and a position shift is likely to be generated due to the positioning accuracy. Meanwhile, in the embodiment, since the communication path 16 and the supply path 19 are provided on the communication plate 15, there is a case where the positioning accuracy of the communication plate 15 and the flow path forming substrate 10 influences the relative positions of the communication path 16 and the supply path 19. In addition, since the actual length of the pressure generation chamber 12 is defined by the part which communicates with the communication path 16 from the part which communicates with the supply path 19, there is not a case where the position shift of the communication plate 15 and the flow path forming substrate 10 influences the actual length of the pressure generation chamber 12 in the embodiment, and it is possible to prevent unevenness in length of the pressure generation chamber 12, and to reduce unevenness of discharge characteristics of the ink.

In addition, in the communication plate 15, it is preferable that the communication path 16 and the supply path 19 be formed by performing the anisotropic etching from one surface side in the third direction Z. In other words, it is appropriate that the communication path 16 and the supply path 19 are formed by using the same mask provided on one surface of the communication plate 15. In this manner, by using the mask which forms the communication path 16, and the same mask as the mask which forms the supply path 19, it is possible to prevent a relative position shift between the communication path 16 and the supply path 19. Meanwhile, when unevenness is generated at the positions between the communication path 16 and the supply path 19, the unevenness is generated in actual length of the pressure generation chamber 12 from the supply path 19 to the communication path 16, unevenness is generated in the discharge characteristics of the ink droplets, and printing quality deteriorates. In the embodiment, by forming the communication path 16 and the supply path 19 using the same mask, it is possible to prevent the position shift between the communication path 16 and the supply path 19, to prevent unevenness of the actual length of the pressure generation chamber 12, to prevent unevenness of the discharge characteristics, and to improve the printing quality.

In addition, by opening the supply path 19 which communicates with the manifold 100 and the pressure generation chamber 12 on the bottom surface of the first recess portion 181, without influencing the depth of the second recess portion 182, it is possible to ensure the flow path length of the supply path 19, and to appropriately perform setting. In other words, it is possible to ensure the length of the supply path 19, to reduce the pressure loss of the supply path 19, and to improve the discharge efficiency. Meanwhile, the pressure loss in the supply path 19 is determined by the diameter and the length of the opening of the supply path 19, but there is a technical restriction in reducing the size of the opening. Therefore, in a case where the discharge efficiency is not sufficient, it is necessary to ensure the length, and to improve the discharge efficiency by the diameter of the opening of the supply path 19. In the embodiment, by opening the supply path 19 on the bottom surface of the first recess portion 181 which is more shallow than the second recess portion 182, even when it is difficult to reduce the size of the diameter of the opening of the supply path 19, it is possible to ensure the length of the supply path 19, and to improve the discharge efficiency. In addition, by providing the second recess portion 182 which is deeper than the first recess portion 181 on which the supply path 19 is open, it is possible to ensure a volume of the second manifold 18, to reduce the pressure loss in the second manifold 18, and to improve the discharge efficiency. In addition, by employing such a configuration, even when there is a tendency for the thickness in the third direction Z of the communication plate 15 to become thin, since it is possible to ensure both the length of the supply path 19 and the depth (the depth of the second recess portion 182) of the second manifold 18, without deterioration of the ink discharge characteristics or the like, that is, without influence on the discharge characteristics, it is possible to achieve a small size of the recording head 1.

Furthermore, in the embodiment, by opening the supply path 19 to the {110} plane which is the bottom surface of the first recess portion 181, that is, a flat surface, when forming the first recess portion 181 by the etching, it is possible to define the flow path length of the supply path 19 at high accuracy, and to form the opening part in the first recess portion 181 side of the supply path 19 at high accuracy. In other words, when the supply path 19 is open to the inclined surface 183, unevenness is generated in the flow path length of the supply path 19 due to the unevenness of the position of the inclined surface 183. In addition, when the supply path 19 is open to the inclined surface 183, accuracy deteriorates without stabilization of the shape of the opening.

In addition, in the embodiment, since the inclined surface 183 is provided between the first recess portion 181 and the second recess portion 182, it is possible to make the angle made by the inclined surface 183 and the bottom surface of the second recess portion 182 an obtuse angle. Therefore, by improving the flow of the ink of the angle portion between the inclined surface 183 and the bottom surface of the second recess portion 182, it is possible to prevent remaining of bubbles in the angle portion. In addition, in the embodiment, since the first recess portion 181 is also formed by the anisotropic etching, an inclined surface similar to the inclined surface 183 is also formed between the first recess portion 181 and a surface to which the nozzle plate 20 of the communication plate 15 is bonded.

In the nozzle plate 20 which is bonded to the Z2 side of the communication plate 15, the nozzle openings 21 which communicates with each compression portion 12 via the communication path 16 is formed. In other words, the nozzle openings 21 which eject the same type of liquid (ink) are aligned in the first direction X, and rows of the nozzle openings 21 which are aligned in the first direction X are formed in two rows in the second direction Y.

Meanwhile, on a surface side on the Z1 side of the flow path forming substrate 10, a vibrating plate 50 is formed. In the embodiment, as the vibrating plate 50, an elastic film 51 made of silicon oxide provided on the flow path forming substrate 10 side, and an insulating body film 52 made of zirconium oxide provided on the elastic film 51, are provided. In addition, the liquid flow path, such as the pressure generation chamber 12, is formed by performing the anisotropic etching the flow path forming substrate 10 from one surface side (surface side to which the nozzle plate 20 is bonded) and the other surface of the pressure generation chamber 12 is divided by the elastic film 51.

In addition, on the vibrating plate 50 of the flow path forming substrate 10, a piezoelectric actuator 300 is configured by layering a first electrode 60, a piezoelectric body layer 70, and a second electrode 80 by forming a film and by performing a lithography method. In the embodiment, the piezoelectric actuator 300 becomes a pressure generator which generates a pressure change of the ink on the inside of the pressure generation chamber 12. Here, the piezoelectric actuator 300 may also be a piezoelectric element 300, and is a part including the first electrode 60, the piezoelectric body layer 70, and the second electrode 80. In addition, when the voltage is applied between the first electrode 60 and the second electrode 80, a part at which piezoelectric distortion is generated in the piezoelectric body layer 70 is referred to as an active portion 310. In the embodiment, will be described later, but the active portions 310 are formed in each of the pressure generation chambers 12. In other words, the plurality of active portions 310 are formed on the flow path forming substrate 10. In addition, in general, any one electrode of the active portion 310 is a common electrode which is common to the plurality of active portions 310, and the other electrode is configured as individual electrodes which are independent in each active portion 310. In the embodiment, the first electrode 60 is an individual electrode, and the second electrode 80 is a common electrode, but may be reverse to each other. In addition, in the above-described example, the vibrating plate 50 and the first electrode 60 act as the vibrating plate, but not being limited thereto, for example, without providing the vibrating plate 50, only the first electrode 60 may act as the vibrating plate. In addition, the piezoelectric actuator 300 itself may substantially serve as the vibrating plate.

Here, the first electrode 60 which configures the piezoelectric actuator 300 of the embodiment is isolated by each of the pressure generation chambers 12, and configures the individual electrode which are independent in each of the active portions 310 that is an actual driving portion of the piezoelectric actuator 300. The first electrode 60 is formed to have a width narrower than the width of the pressure generation chamber 12 in the first direction X of the pressure generation chamber 12. In other words, in the first direction X of the pressure generation chamber 12, an end portion of the first electrode 60 is disposed on the inner side of a region opposes the pressure generation chamber 12. In addition, in the second direction Y, both end portions of the first electrode 60 respectively extend to the outer side of the pressure generation chamber 12.

The piezoelectric body layers 70 are provided to be continuous throughout the first direction X to have a predetermined width in the second direction Y. The width in the second direction Y of the piezoelectric body layer 70 is wider than the length in the second direction Y of the pressure generation chamber 12. Therefore, in the second direction Y of the pressure generation chamber 12, the piezoelectric body layer 70 is provided to the outer side of the pressure generation chamber 12.

In the second direction Y of the pressure generation chamber 12, the end portion on the ink supply path side of the piezoelectric body layer 70 is disposed further outwards than the end portion of the first electrode 60. In other words, the end portion of the first electrode 60 is covered with the piezoelectric body layer 70. In addition, the end portion on the nozzle opening 21 side of the piezoelectric body layer 70 is disposed further inwards (the pressure generation chamber 12 side) than the end portion of the first electrode 60, and the end portion on the nozzle opening 21 side of the first electrode 60 is not covered with the piezoelectric body layer 70.

The piezoelectric body layer 70 is made of a piezoelectric material of an oxide having a polarization structure formed on the first electrode 60, and for example, the piezoelectric body layer 70 can be made of a perovskite type oxide illustrated by a general equation $ABO_3$, and can be made of a lead based piezoelectric material including lead or a non-lead based piezoelectric material which does not include lead.

In the piezoelectric body layer 70, a recess portion 71 which corresponds each partition wall is formed. The width in the first direction X of the recess portion 71 is substantially the same as the width in the first direction X of each partition wall, or is wider than that. Accordingly, since rigidity of a part (a so-called arm portion of the vibrating plate 50) which opposes the end portion in the second direction Y of the pressure generation chamber 12 of the vibrating plate 50 is prevented, it is possible to excellently displace the piezoelectric actuator 300.

The second electrode 80 is provided on a surface opposite to the first electrode 60 of the piezoelectric body layer 70, and configures a common electrode which is common to a plurality of active portions 310. In addition, the second electrode 80 may be provided on an inner surface of the recess portion 71, that is, a side surface of the recess portion 71 of the piezoelectric body layer 70, or may not be provided.

In addition, an individual wiring 91 which is a lead-out wiring is led out from the first electrode 60 of the piezoelectric actuator 300. In addition, a common wiring 92 which is a lead-out wiring is led out from the second electrode 80. Furthermore, a flexible cable 120 is connected to the end portions which are arranged on a side opposite to the end portion connected to the piezoelectric actuator 300 of the individual wiring 91 and the common wiring 92. The flexible cable 120 is a wiring substrate having flexibility, and in the embodiment, a driving circuit 121 which is a driving element is mounted thereon.

A protection substrate 30 which has a size substantially the same as the flow path forming substrate 10 is bonded to the surface side on the Z1 side of the flow path forming substrate 10. The protection substrate 30 has a holding portion 31 which is a space for protecting the piezoelectric actuator 300. Two holding portions 31 are formed to be aligned in the second direction Y between the rows of the piezoelectric actuator 300 that are arranged in the first direction X. In addition, in the protection substrate 30, a through hole 32 which penetrates in the third direction Z between the two holding portions 31 that are arranged in the second direction Y, is provided. The end portions of the individual wiring 91 and the common wiring 92 which are led out from the electrode of the piezoelectric actuator 300 extends to be exposed to the inside of the through hole 32, and the individual wiring 91 and the common wiring 92, and the flexible cable 120 are electrically connected to each other on the inside of the through hole 32. In addition, a connecting method of the individual wiring 91 and the common wiring 92, and the flexible cable 120, is not particularly limited, and for example, conductive adhesive (ACP, ACF) including conductive particles, a non-conductive adhesive (NCP, NCF), or the like, including brazing and soldering, such as soldering or brazing, eutectic bonding, or welding, is employed.

In addition, the case member 40 which divides the manifold 100 that communicates with the plurality of pressure generation chambers 12 together with the flow path forming substrate 10, is fixed onto the protection substrate 30. The case member 40 has a shape which is substantially the same as the above-described communication plate 15 in a plan view, is bonded to the protection substrate 30, and is also bonded to the above-described communication plate 15. Specifically, the case member 40 has a recess portion 41 having a depth by which the flow path forming substrate 10 and the protection substrate 30 are accommodated on the protection substrate 30 side. The recess portion 41 has an opening area which is wider than a surface bonded to the flow path forming substrate 10 of the protection substrate 30. In addition, in a state where the flow path forming substrate 10 or the like is accommodated in the recess portion 41, the opening surface on the nozzle plate 20 side of the recess portion 41 is sealed by the communication plate 15. Accordingly, on an outer circumferential portion of the flow path forming substrate 10, a third manifold portion 42 is divided by the case member 40 and the flow path forming substrate 10. In addition, the manifold 100 of the embodiment is configured of the first manifold portion 17 and the second manifold portion 18 which are provided on the communication plate 15, and the third manifold portion 42 divided by the case member 40 and the flow path forming substrate 10.

The manifolds 100 are provided to be continuous throughout the first direction X which is the arranging direction of the pressure generation chamber 12, and the supply paths 19 which communicate with each of the pressure generation chamber 12 and the manifold 100 are aligned in the first direction X.

In addition, on the surface on the Z2 side on which the first manifold portion 17 and the second manifold portion 18 of the communication plate 15 are open, a compliance substrate 45 is provided. The compliance substrate 45 seals an opening on the liquid ejecting surface 20*a* side of the first manifold portion 17 and the second manifold 18. In the embodiment, the compliance substrate 45 includes a sealing film 46 made of a flexible thin film, and a fixing substrate 47 made of a hard material, such as metal. A region which opposes the manifold 100 of the fixing substrate 47 becomes an opening portion 48 which is completely removed in the thickness direction, one surface of the manifold 100 becomes a compliance portion 49 which is a flexible portion which is sealed only with the flexible sealing film 46.

In addition, in the case member 40, an introduction path 44 for penetrating the manifold 100 and supplying the ink to each of the manifolds 100, is provided. In addition, in the case member 40, a connection port 43 which communicates with the through hole 32 of the protection substrate 30, and into which the flexible cable 120 inserts, is provided.

In the recording head 1, when ejecting the ink, the ink is taken in from the introduction path 44, and the inside of the flow path from the manifold 100 to the nozzle opening 21, is filled with the ink. After this, in accordance with a signal from the driving circuit 121, by applying the voltage to each of the active portions 310 which correspond to the pressure generation chambers 12, the vibrating plate 50 is deflected together with the active portion 310. Accordingly, the pressure on the inside of the pressure generation chamber 12 increases, and the ink droplets are ejected from the predetermined nozzle opening 21.

Here, a manufacturing method of the recording head 1, in particular, a forming method of the communication plate 15 will be described with reference to FIGS. 8 to 14. In addition, FIGS. 8 to 14 are sectional views illustrating the manufacturing method of the recording head.

Figure 8:
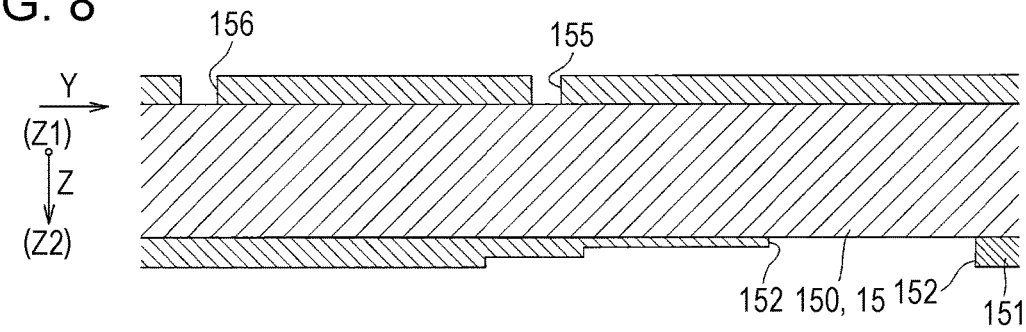
FIG. 8 is a sectional view illustrating a manufacturing method of the recording head according to Embodiment 1 of the invention.

First, as illustrated in FIG. 8, a mask 151 having an opening portion 152 which is a silicon single crystal substrate that becomes the communication plate 15, and which is at a part that becomes the first manifold portion 17 on the front surface of a base material 150, is formed. At this time, the mask 151 in the region in which the second recess portion 182 is formed and the region in which the first recess portion 181 is formed, gradually becomes thin by half etching. Accordingly, by reducing the thickness of the mask 151 in the later processing, the region in which the first recess portion 181 is formed and the region in which the second recess portion 182 is formed gradually become open. In addition, in the mask 151 provided on the other surface side opposite to the mask 151 on one surface side on which the opening portion 152 is formed, an opening portion 155 is formed in the region in which the supply path 19 is formed, and an opening portion 156 is formed in the region in which the communication path 16 is formed.

Figure 9:
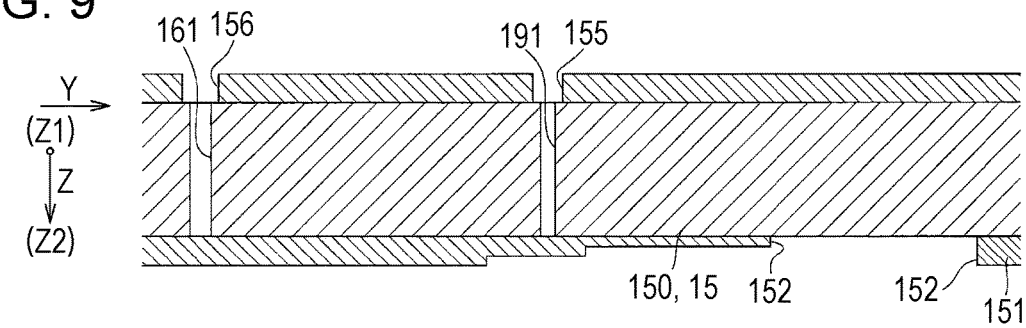
FIG. 9 is a sectional view illustrating the manufacturing method of the recording head according to Embodiment 1 of the invention.

Next, the communication path 16 and the supply path 19 are formed. In the embodiment, as illustrated in FIG. 9, after forming a communication path lower hole 161 that becomes the communication path 16, and forming a supply path lower hole 191 that becomes the supply path 19, in the later processing, when the first manifold portion 17 and the second manifold portion 18 are formed by performing the anisotropic etching with respect to the base material 150, the communication path 16 and the supply path 19 are formed by etching the inner wall surfaces of the communication path lower hole 161 and the supply path lower hole 191 at the same time. In addition, the communication path lower hole 161 and the supply path lower hole 191 can be formed by laser processing, dry etching, or sandblasting processing.

Figure 10:
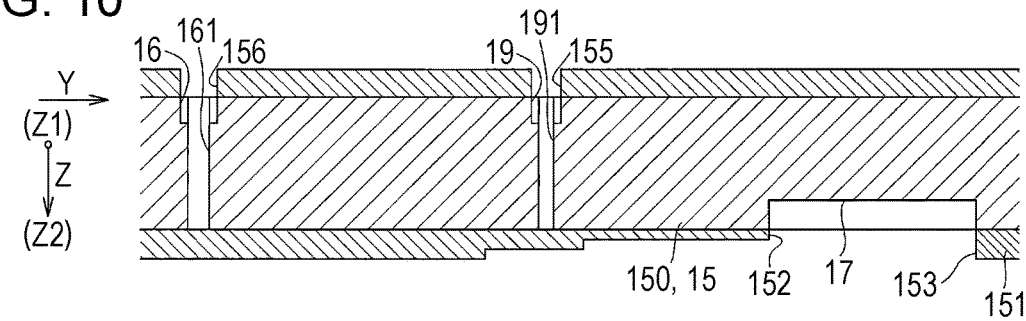
FIG. 10 is a sectional view illustrating the manufacturing method of the recording head according to Embodiment 1 of the invention.

Next, as illustrated in FIG. 10, by performing the anisotropic etching using the alkaline solution, such as KOH, with respect to the base material 150, a part of the depth of the first manifold portion 17 is formed. In other words, here, without completely forming the depth of the first manifold portion 17, only the part is formed. In addition, in the anisotropic etching for forming a part of the first manifold portion 17, by performing the etching the inner wall surfaces of the communication path lower hole 161 and the supply path lower hole 191 at the same time, a part in the depth direction of the communication path 16 and the supply path 19 are formed.

Figure 11:
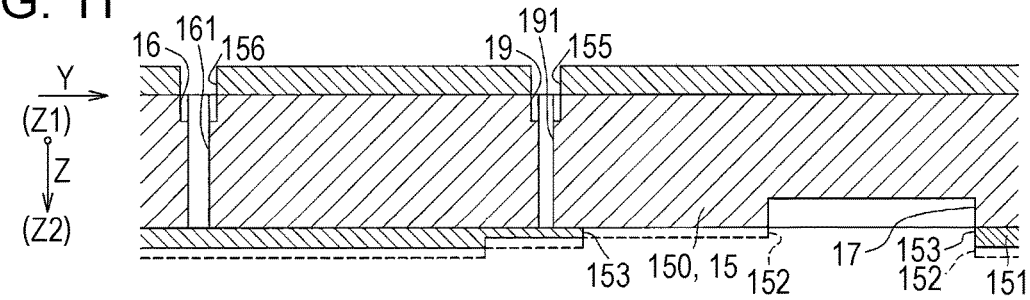
FIG. 11 is a sectional view illustrating the manufacturing method of the recording head according to Embodiment 1 of the invention.

Next, as illustrated in FIG. 11, the thickness of the mask 151 is thin. Accordingly, an opening portion 153 is formed in the region in which the second recess portion 182 is formed.

Figure 12:
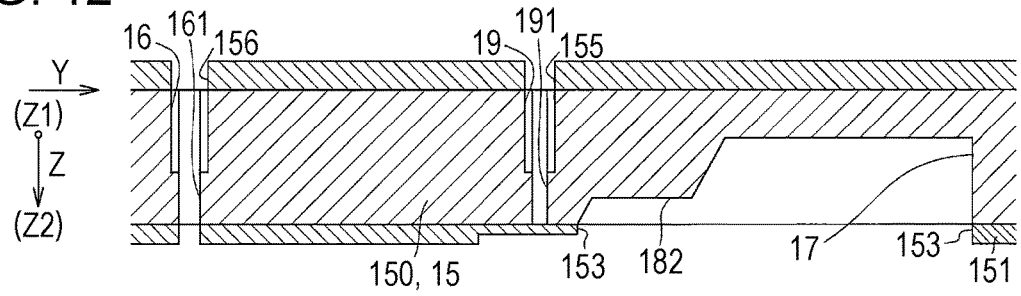
FIG. 12 is a sectional view illustrating the manufacturing method of the recording head according to Embodiment 1 of the invention.

Next, as illustrated in FIG. 12, by performing the anisotropic etching with respect to the base material 150, a part of the depth of the second recess portion 182 is formed. In addition, by performing the anisotropic etching with respect to the base material at the same time, a part of the depth of the first manifold portion 17 is also formed. Furthermore, by etching the inner wall surfaces of the communication path lower hole 161 and the supply path lower hole 191 at the same time, a part in the depth direction of the communication path 16 and the supply path 19 is formed.

Figure 13:
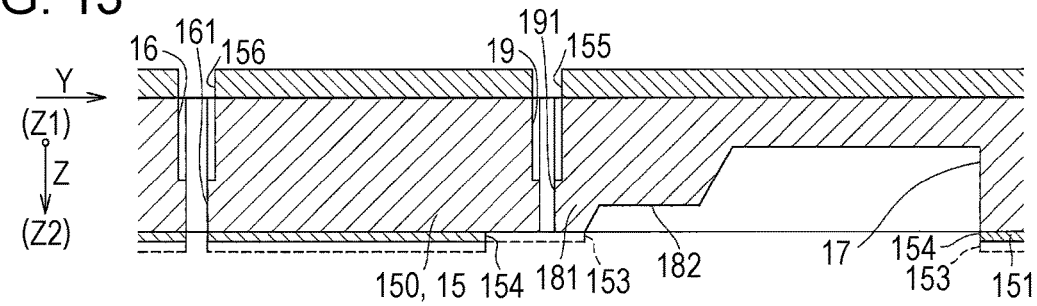
FIG. 13 is a sectional view illustrating the manufacturing method of the recording head according to Embodiment 1 of the invention.

Next, as illustrated in FIG. 13, the thickness of the mask 151 is thin. Accordingly, in addition to the region in which the second recess portion 182 is formed, an opening portion 154 which is open is also formed, in the region in which the first recess portion 181 is formed.

Figure 14:
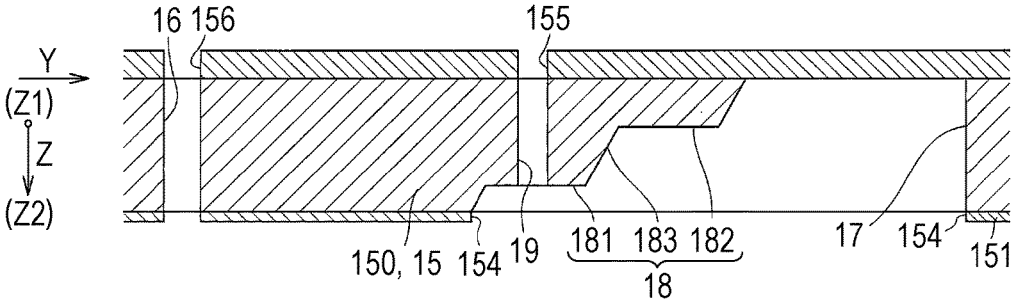
FIG. 14 is a sectional view illustrating the manufacturing method of the recording head according to Embodiment 1 of the invention.

Next, as illustrated in FIG. 14, by performing the anisotropic etching with respect to the base material 150, the second manifold portion 18 which has the first recess portion 181 and the second recess portion 182 is formed. In other words, in the processing, a remaining part of the second recess portion 182 is formed at the same time when the first recess portion 181 is formed. In other words, the first manifold portion 17 is completely formed. In addition, at the same time, by etching the inner wall surface of the communication path lower hole 161 and the supply path lower hole 191 at the same time, the communication path 16 and the supply path 19 are completely formed.

By performing the above-described processing, in the communication plate 15, the communication path 16, the supply path 19, the second manifold portion 18 having the first recess portion 181 and the second recess portion 182, and the first manifold portion 17, are formed.

In this manner, since the base material 150 of the communication plate 15 is made of a silicon single crystal substrate in which the crystal plane orientation of the front surface is a {110} plane, the bottom surfaces of the first recess portion 181 and the second recess portion 182 is formed of the {110} plane. In addition, the inclined surface 183 between the first recess portion 181 and the second recess portion 182 is formed of the first inclined surface 183*a* which is an arbitrary surface (etching rate is high), and the second inclined surface 183*b* which is the third {111} plane (refer to FIG. 7). Therefore, processing of additionally forming the inclined surface 183 becomes unnecessary, and it is possible to reduce costs.

In addition, by forming the communication path 16 and the supply path 19 by the anisotropic etching from one surface side, it is possible to form the communication path 16 and the supply path 19 using the same mask 151. In addition, by forming the communication path 16 and the supply path 19 using the same mask 151, it is possible to prevent a position shift between the communication path 16 and the supply path 19. Therefore, it is possible to prevent unevenness of the actual length of the pressure generation chamber 12, to prevent unevenness of the discharge characteristics, and to improve printing quality.

Embodiment 2

Figure 15:
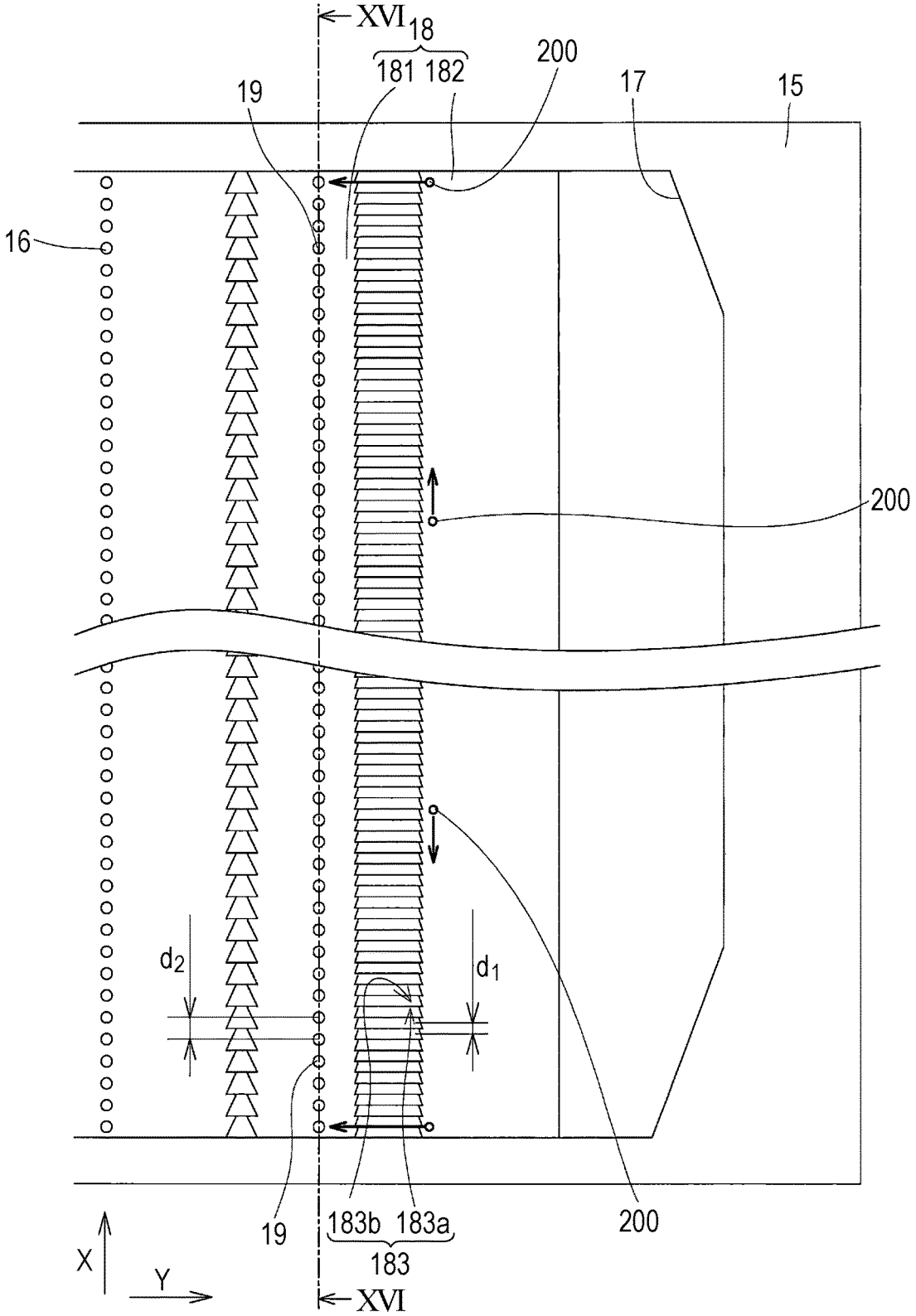
FIG. 15 is a plan view of a communication plate according to Embodiment 2 of the invention.
Figure 16:
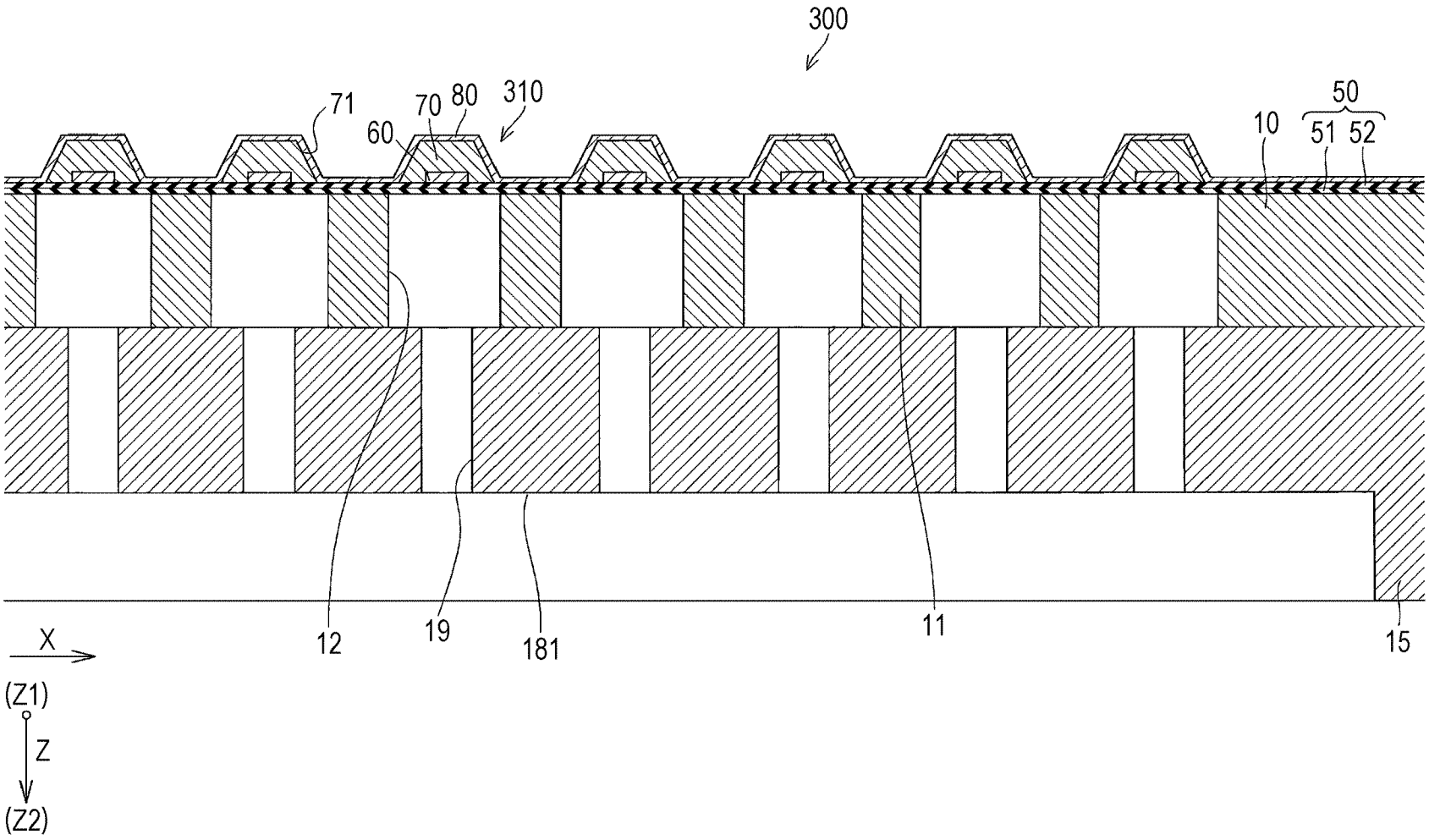
FIG. 16 is a sectional view in which main portions of a recording head according to Embodiment 2 of the invention are enlarged.
Figure 17:
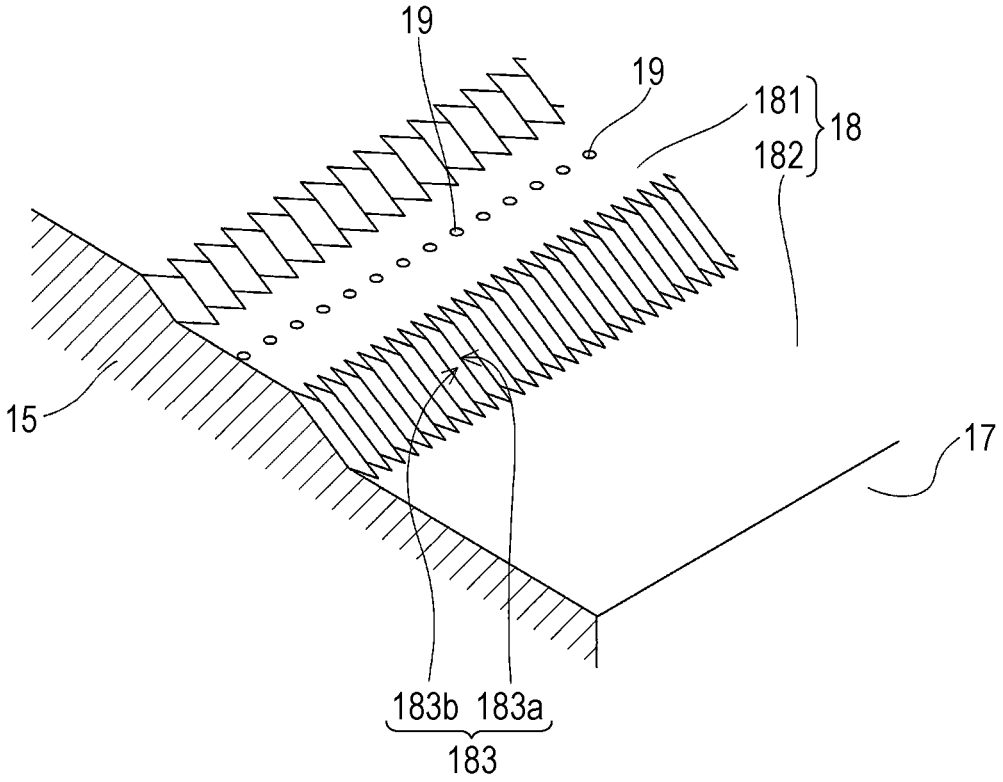
FIG. 17 is a perspective view in which the main portions of the communication plate according to Embodiment 2 of the invention are cut out.

FIG. 15 is a plan view of the communication plate according to Embodiment 2 of the invention, FIG. 16 is a sectional view in which the main portions of the recording head based on the line XVI-XVI in FIG. 15, and FIG. 17 is a perspective view when the main portions of the communication plate are cut out. In addition, members similar to those of the above-described embodiment 1 are given the same reference numerals, overlapping description will be omitted.

As illustrated in the drawings, the supply paths 19 which communicate with the pressure generation chamber 12 and the manifold 100 are arranged in a linear shape in the first direction X. In addition, the supply path 19 is provided to be open on the bottom surface of the first recess portion 181.

In the embodiment, as illustrated in FIG. 15, a pith $d_1$ in the first direction X of the second inclined surface 183*b* that configures the inclined surface 183, is smaller than a pith $d_2$ of the supply path 19 ($d_1<d_2$). Meanwhile, the bubble discharge characteristics in the inclined surface 183 are determined by the ink speed in the first direction X, the ink characteristics, and the pith $d_1$ of the second inclined surface 183*b*. In addition, the pith $d_1$ is a distance between the centers of the second inclined surfaces 183*b* adjacent to each other in the first direction X, and the pith $d_2$ is a distance between the centers of the supply paths 19 adjacent to each other in the first direction X.

In this manner, by making the pith $d_1$ of the second inclined surface 183*b* smaller than the pith $d_2$ of the supply path 19, it is possible to prevent bubbles 200 which moves in the first direction X in the inclined surface 183 from being caught, and to make it easy to move the bubbles 200 in the first direction X along the inclined surface 183. In other words, the bubbles 200 incorporated in the ink on the inside of the manifold 100 can move and grow in the first direction X along the inclined surface 183 on the bottom surface (ceiling surface in the vertical direction) of the second recess portion 182, and can be likely to be discharged by sweeping away the grown bubbles 200 by the ink.

In addition, since the inclined surface 183 is provided between the first recess portion 181 and the second recess portion 182, it is possible to make the angle made by the bottom surfaces of the inclined surface 183 and the second recess portion 182 an obtuse angle. Therefore, it is possible to improve the flow of the ink of the angle portion between the bottom surfaces of the inclined surface 183 and the second recess portion 182, and to prevent the bubbles from remaining in the angle portion. In addition, in the embodiment, since the first recess portion 181 is also formed by the anisotropic etching, an inclined surface similar to the inclined surface 183 is also formed between the first recess portion 181 and the surface to which the nozzle plate 20 of the communication plate 15 is bonded. A pitch of the inclined surface between the first recess portion 181 and the surface to which the nozzle plate 20 of the communication plate 15 is bonded, may be a pitch similar to that of the inclined surface 183, and may be a pitch similar to that of the supply path 19.

Meanwhile, the pith $d_2$ of the supply path 19 is formed according to the pitch of the nozzle opening 21, and in a case where the nozzle opening 21 is 300 dpi, the pith $d_2$ of the supply path 19 becomes approximately 84.7 μm. Meanwhile, the pith $d_1$ of the second inclined surface 183*b* may be a pitch smaller than 84.7 μm, and for example, it is preferable that a pitch of a case where the nozzle opening 21 be 600 dpi, that is, equal to or smaller than approximately 42.4 μm, and it is appropriate that a pitch of a case of 1200 dpi, that is, approximately 21.3 μm. In this manner, by making the pith $d_1$ of the second inclined surface 183*b* equal to or less than approximately 42.4 μm, and preferably, equal to or less than 21.3 μm, since overhanging in the second direction Y of the inclined surface 183 becomes small, the bubbles 200 is not caught on the inclined surface 183, and it is possible to move the bubbles 200 in the first direction X.

In addition, by using a part of the supply path 19 as a dummy supply path which is not used in discharging the ink and communicates with a dummy pressure generation chamber, and by reducing the flow path resistance from the dummy supply path to the nozzle opening 21 to be small, by moving the bubbles 200 in the first direction X along the inclined surface 183, it is possible to easily discharge the bubbles 200 from the dummy supply path.

Figure 18:
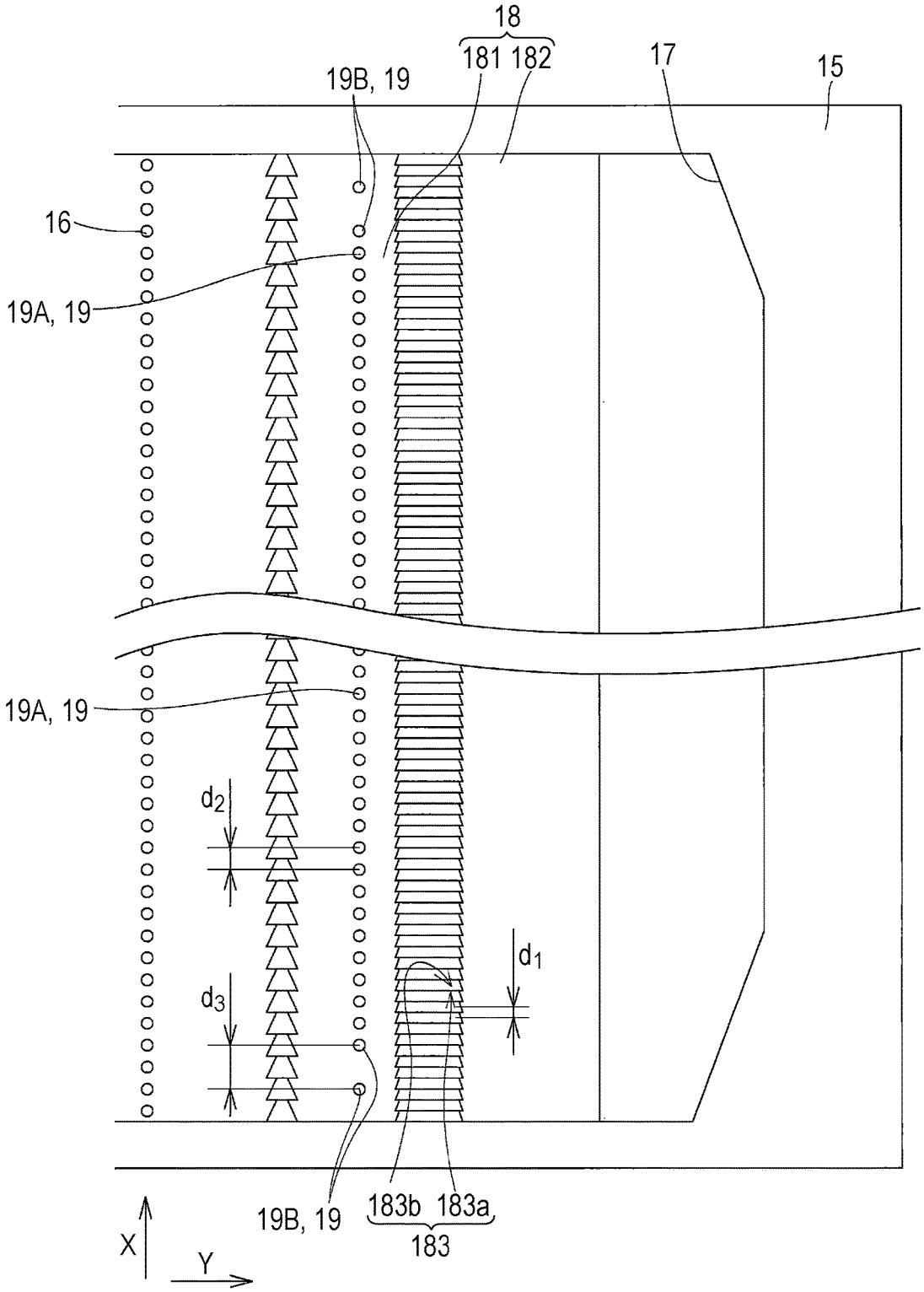
FIG. 18 is a plan view of a modification example of the communication plate according to Embodiment 2 of the invention.

Here, the example is illustrated in FIG. 18. FIG. 18 is a plan view illustrating a modification example of the communication plate according to Embodiment 2 of the invention.

As illustrated in FIG. 18, the supply path 19 is divided into a discharge supply path 19A and a dummy supply path 19B. One or more, in the embodiment, two dummy supply paths 19B are provided in each of both end portions in the first direction X in the arranging direction of the supply path 19.

A pith $d_3$ of the dummy supply path 19B is greater than the pith $d_2$ of the discharge supply path 19A ($d_3>d_2$). In this manner, by making the pith $d_3$ of the dummy supply path 19B greater than the pith $d_2$ of discharge supply path 19A, it is possible to enlarge the sectional area of the flow path from the dummy supply path 19B to the nozzle opening 21. In other words, by increasing the pith $d_3$ of the dummy supply paths 19B adjacent to each other, it is possible to ensure a space between the dummy supply paths 19B adjacent to each other. Therefore, it is possible to increase the opening diameter of the dummy supply path 19B. In addition, when the pitch of the pressure generation chamber 12 which communicates with the dummy supply path 19B is also increases according to the dummy supply path 19B, it is possible to increase the cross-sectional area of the pressure generation chamber 12 which communicates with the dummy supply path 19B regardless of the opening diameter of the dummy supply path 19B. Similarly, it is also possible to increase the cross-sectional area of the communication path 16, and to increase the nozzle opening 21. In other words, by increasing the pith $d_3$ of the dummy supply path 19B, it is also possible to increase the pitch of the flow path of the pressure generation chamber 12, the communication path 16, and the nozzle opening 21, which communicate with the dummy supply path 19B. In other words, by increasing the pith $d_3$ of the dummy supply path 19B, it is possible to increase at least one cross-sectional area which is selected from the dummy supply path 19B, the pressure generation chamber 12, the communication path 16, and the nozzle opening 21. Accordingly, it is possible to reduce the flow path resistance from the dummy supply path 19B to the nozzle opening 21, compared to the flow path resistance from the discharge supply path 19A to the nozzle opening 21, and to further improve the bubble discharge characteristics.

In this manner, by making it easy to discharge the bubbles 200 incorporated in the ink on the inside of the manifold 100, from the nozzle opening 21 via the dummy supply path 19B, since it is possible to prevent the bubbles 200 from being incorporated into the discharge supply path 19A or the pressure generation chamber 12, and the communication path 16 and the nozzle opening 21 by using the discharge, such as printing, it is possible to prevent a discharge failure of the ink droplets.

In addition, in the example illustrated in FIG. 18, the dummy supply paths 19B are provided in each of both end portions in the first direction X which is the arranging direction of the supply path 19, but not being particularly limited thereto, the position of the dummy supply path 19B is not particularly limited. Even when the dummy supply path 19B is disposed in any position, the bubbles 200 are likely to move toward the dummy supply path 19B along the inclined surface 183, and it is possible to improve the bubble discharge characteristics. It is needless to say that the number of dummy supply paths 19B, that is, the number of dummy pressure generation chambers 12B, is also not particularly limited thereto, and may be one, or may be two or more.

In addition, in the example illustrated in FIG. 18, a case where suction-cleaning is performed with respect to all of the nozzle openings 21 is described, but it is needless to say that the suction-cleaning may be performed only with respect to the nozzle opening 21 which communicates with the pressure generation chamber 12 that communicates with the dummy supply path 19B. In other words, a suction unit which performs the suction-cleaning only from the nozzle opening 21 which communicates with the pressure generation chamber 12 that communicates with the dummy supply path 19B, may be provided. As a suction unit, it is possible to use a known unit in the related art including a cap which abuts against the liquid ejecting surface 20*a*, and covers the nozzle opening 21; and a suction device, such as a suction pump which suctions the inside of the cap, and makes the pressure thereof a negative pressure. Meanwhile, in a case where the suction unit suctions only the nozzle opening 21 which communicates with the pressure generation chamber 12 that communicates with the dummy supply path 19B, the cap which covers only the nozzle opening 21 which communicates with the pressure generation chamber 12 that communicates with the dummy supply path 19B, may be provided. In addition, in a case where the cap covers all of nozzle openings 21, a closing unit which closes parts other than the nozzle opening 21 which communicates with the pressure generation chamber 12 that communicates with the dummy supply path 19B, may further be provided. In this manner, in a case where the suction-cleaning is performed only from the nozzle opening 21 which communicates with the pressure generation chamber 12 that communicates with the dummy supply path 19B, it is possible to easily move the bubbles 200 in the first direction X along the inclined surface 183, and to more efficiently perform the discharge of the bubbles of the ink from the dummy supply path 19B. In addition, in the example illustrated in FIG. 18, the dummy supply paths 19B are respectively provided in both end portions in the first direction X which is the arranging direction of the supply path 19. Therefore, it is possible to discharge the bubbles of both end portions from the dummy supply path 19B in the first direction X in which the bubbles are likely to remain in the manifold 100, and to further prevent the bubbles from remaining. It is needless to say that a suction operation performed by the suction unit may be selectively performed with respect to the nozzle opening 21 of the recording head which does not have the dummy supply path 19B. Accordingly, the bubbles 200 moves on the inclined surface 183 toward the supply path 19 which communicates with the nozzle opening 21 to which the suction operation is performed, and it is possible to improve the bubble discharge characteristics from the nozzle opening 21 to which the suction operation is performed.

Embodiment 3

Figure 19:
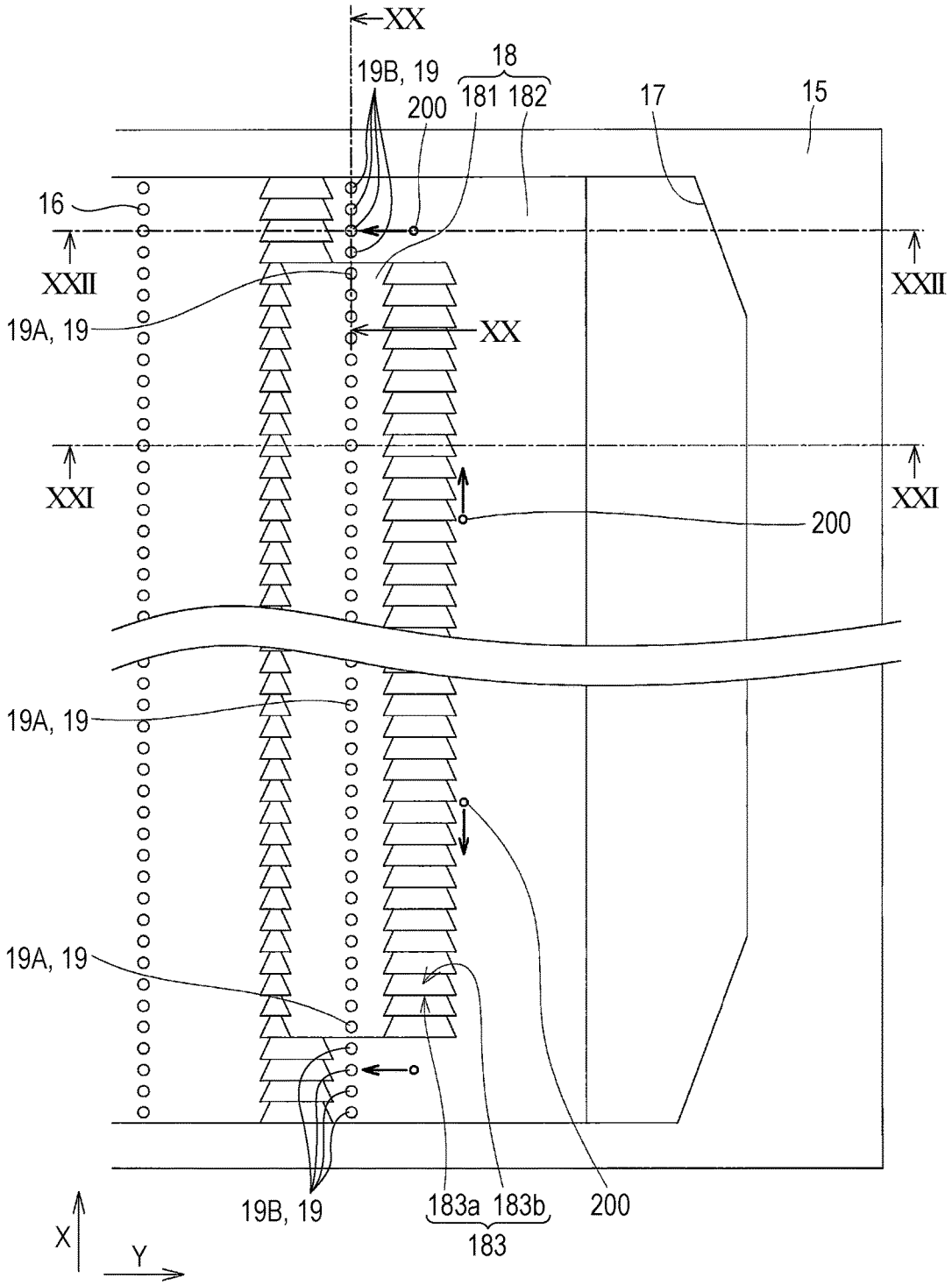
FIG. 19 is a plan view of a communication plate according to Embodiment 3 of the invention.
Figure 20:
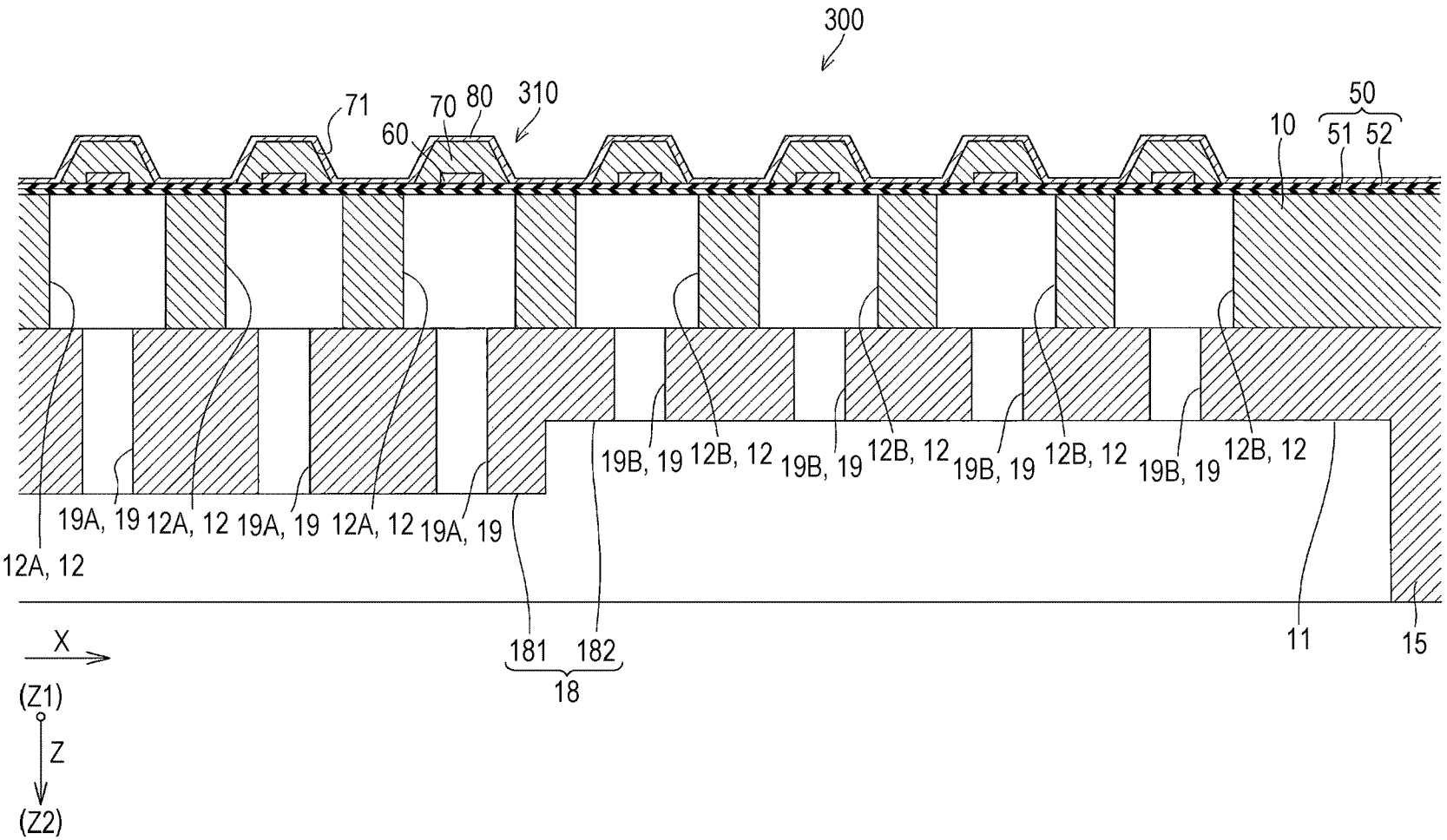
FIG. 20 is a sectional view in which main portions of a recording head according to Embodiment 3 of the invention are enlarged.
Figure 21:
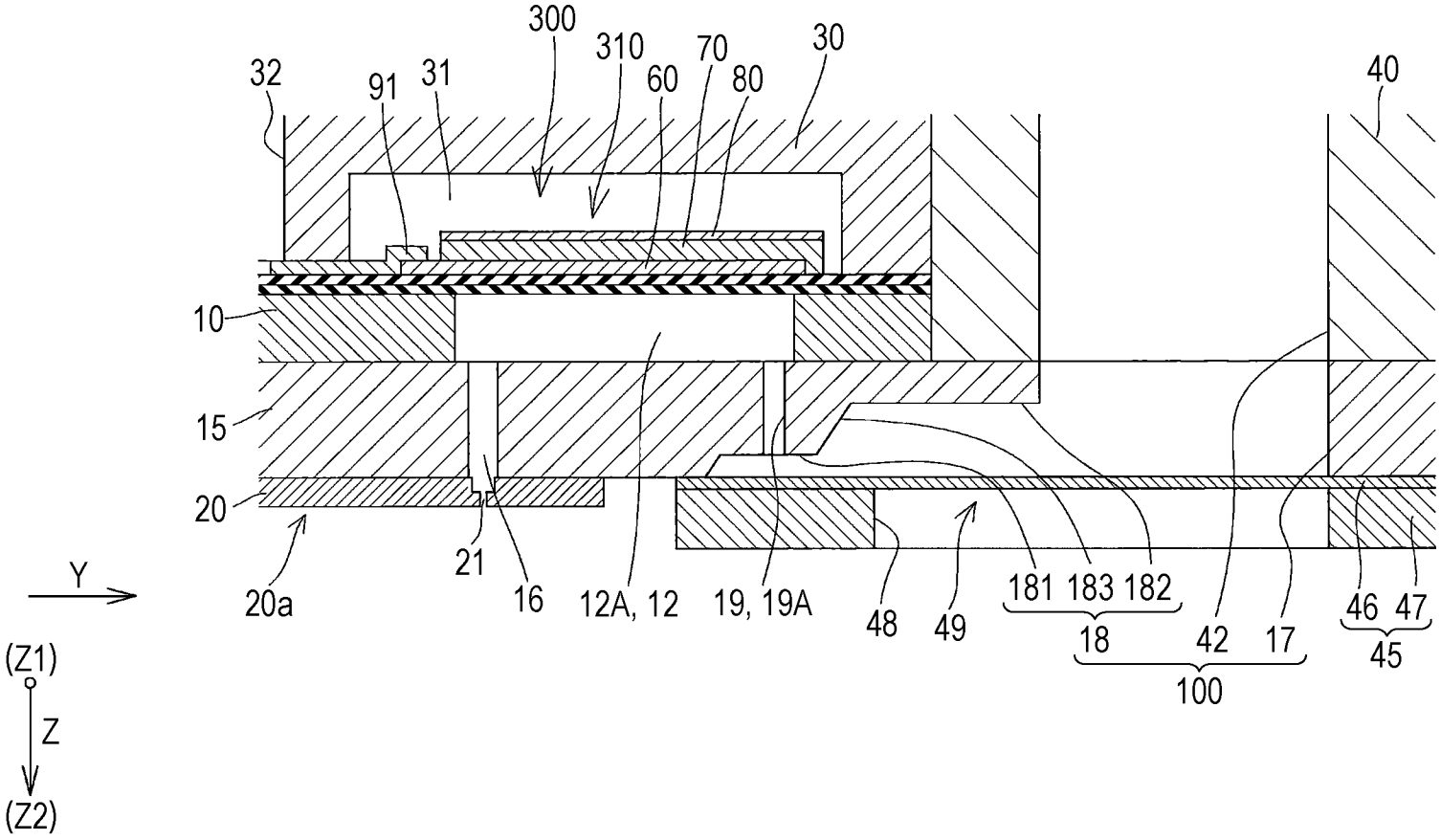
FIG. 21 is a sectional view in which the main portions of the recording head according to Embodiment 3 of the invention are enlarged.
Figure 22:
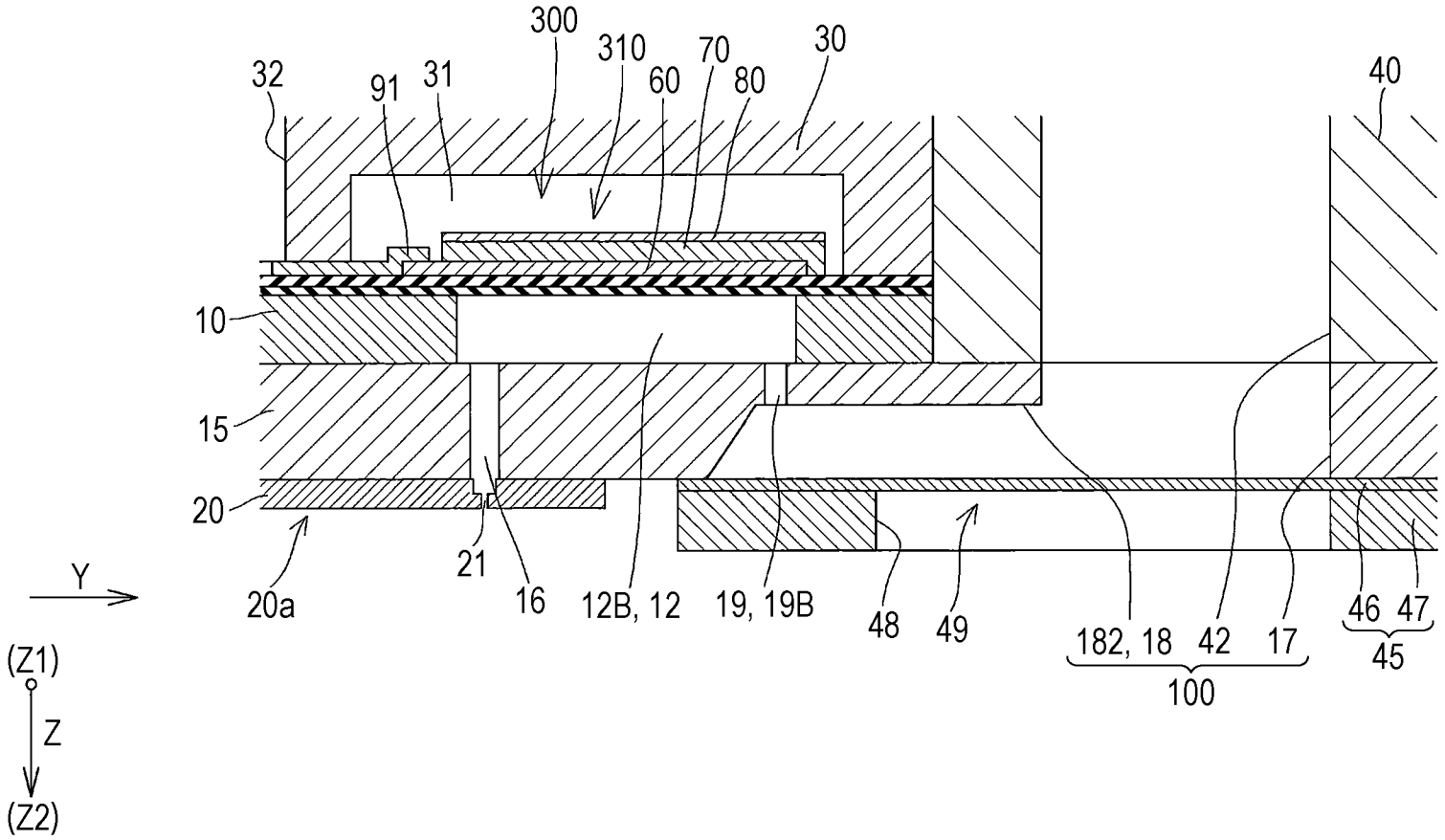
FIG. 22 is a sectional view in which the main portions of the recording head according to Embodiment 3 of the invention are enlarged.
Figure 23:
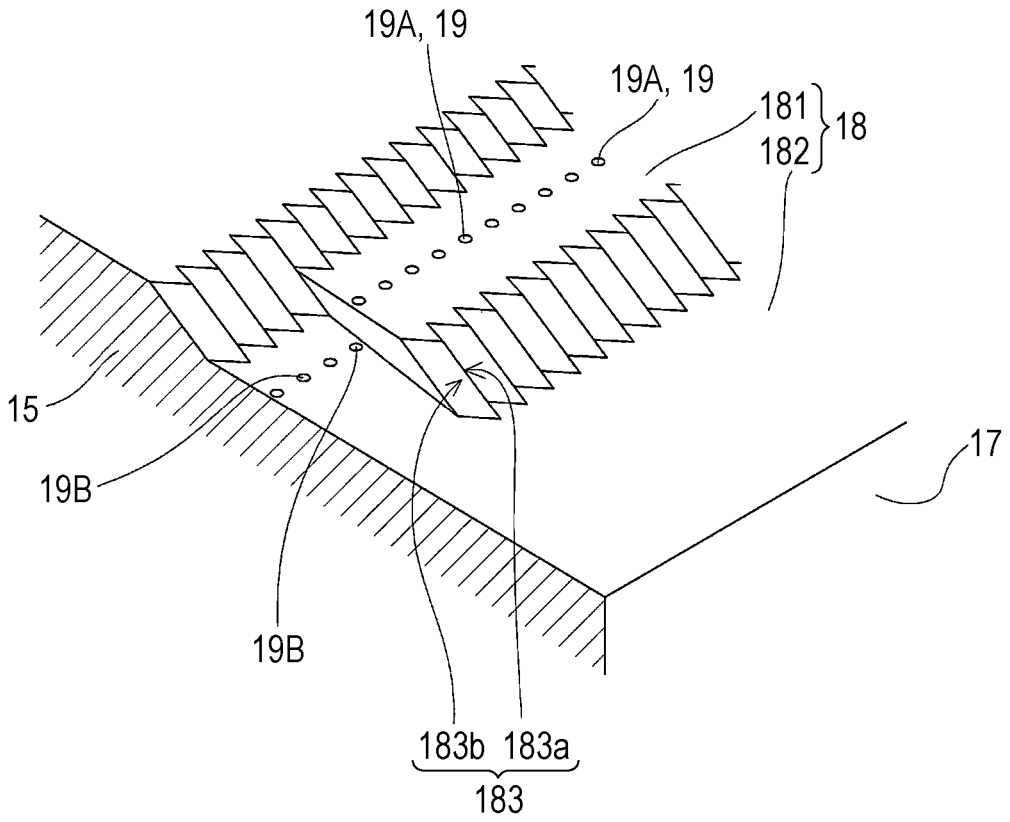
FIG. 23 is a perspective view in which main portions of the communication plate according to Embodiment 3 of the invention are cut out.

FIG. 19 is a plan view of the communication plate according to Embodiment 3 of the invention, FIG. 20 is a sectional view in which the main portions of the recording head based on the line XX-XX in FIG. 19 are enlarged, FIG. 21 is a sectional view in which the main portions of the recording head based on the line XXI-XXI in FIG. 19 are enlarged, FIG. 22 is a sectional view in which the main portions of the recording head based on the line XXII-XXII in FIG. 19 are enlarged, and FIG. 23 is a perspective view in which the main portions of the communication plate are cut out. In addition, the members similar to those of the above-described embodiments are given the same reference numerals, and overlapping description will be omitted.

In the embodiment, as illustrated in the drawings, the pressure generation chamber 12 is divided into a discharge pressure generation chamber 12A which is used in discharging the ink droplets from the communicating nozzle opening 21, and a dummy pressure generation chamber 12B which is not used in discharging the ink droplets from the communicating nozzle opening 21. In addition, the dummy pressure generation chamber 12B which is not used in discharging the ink droplets, is a member which forms characters or images by landing the ink droplets to an ejecting medium, such as a paper sheet or a recording sheet, and is called a so-called member which is not used in printing. In other words, the ink droplets which are discharged from the nozzle opening 21 which communicates with the discharge pressure generation chamber 12A are used in printing. Meanwhile, when the ink droplets are not used in printing, that is, when the ink droplets are not landed to the ejecting medium, the ink droplets may be discharged by driving the piezoelectric actuator 300 from the nozzle opening 21 which communicates with the dummy pressure generation chamber 12B. In addition, the ink is discharged during the cleaning from the nozzle opening 21 which communicates with the dummy pressure generation chamber 12B. Meanwhile, as the cleaning, suction cleaning of suctioning the ink on the inside of the dummy pressure generation chamber 12B and the manifold 100 from the nozzle opening 21 together with the bubbles or dust, by discharging the ink droplets, which is a so-called brushing, by covering the nozzle opening 21 with the cap, and by making the pressure on the inside of the cap a negative pressure by the suction pump or the like, is performed.

In the embodiment, among the pressure generation chambers 12 which are aligned in the first direction X, one or more pressure generation chambers 12 which are provided on both end portions in the first direction X are the dummy pressure generation chambers 12B, and other pressure generation chambers 12 are the discharge pressure generation chambers 12A. In addition, in the embodiment, four dummy pressure generation chambers 12B are provided in each of both end portions in the first direction X, and a total of eight dummy pressure generation chambers 12B are provided.

In addition, the supply path 19 is divided into the discharge supply path 19A which communicates with the discharge pressure generation chamber 12A, and the dummy supply path 19B which communicates with the dummy pressure generation chamber 12B. In addition, as illustrated in FIGS. 19, 20, 21, and 23, the discharge supply path 19A is provided to be open on the bottom surface of the first recess portion 181. Accordingly, it is possible to ensure the flow path length of the discharge supply path 19A which communicates with the manifold 100 and the discharge pressure generation chamber 12A to be long.

Meanwhile, as illustrated in FIGS. 19, 20, 22, and 23, the dummy supply path 19B is provided to be open on the bottom surface of the second recess portion 182. In other words, at a part at which the dummy supply path 19B is open among the supply paths 19, the second recess portion 182 is formed. In other words, since the supply paths 19 are aligned in the first direction X, the first recess portion 181 is provided on a center portion side in the aligning direction of the supply paths 19, the second recess portion 182 extends to both end portion sides in the aligning direction of the supply path 19. By opening the dummy supply path 19B on the bottom surface of the second recess portion 182, it is possible to shorten the flow path length of the dummy supply path 19B which communicates with the manifold 100 and the dummy pressure generation chamber 12B compared to the discharge supply path 19A. In addition, in the embodiment, a difference in length between the discharge supply path 19A and the dummy supply path 19B is generated in the embodiment by opening the discharge supply path 19A and the dummy supply path 19B on the same surface on the Z1 side in the third direction Z. Therefore, in a case where positions at which the discharge supply path 19A and the dummy supply path 19B are open on the Z1 side, it is necessary to dispose the opening on the Z1 side so that a relationship between the lengths of the discharge supply path 19A and the dummy supply path 19B is the same as the above-described condition.

In this manner, by opening the discharge supply path 19A on the bottom surface of the first recess portion 181, without being influenced by the length of the discharge supply path 19A and the depth of the second recess portion 182, it is possible to appropriately set the necessary length. In other words, it is possible to ensure the length of the discharge supply path 19A, to reduce the pressure loss of the discharge supply path 19A, and to improve the discharge efficiency. In addition, by providing the second recess portion 182 which is deeper than the first recess portion 181 in which the discharge supply path 19A is open, it is possible to ensure a volume of the second manifold 18, to reduce the pressure loss in the second manifold 18, and to improve the discharge efficiency. In addition, by employing such a configuration, even when there is a tendency for the thickness in the third direction Z of the communication plate 15 for becoming thin, it is possible to ensure both of the length of the discharge supply path 19A and the depth of the second manifold portion 18 (depth of the second recess portion 182), and accordingly, without deterioration of the ink discharge characteristics or the like, that is, without influence on the discharge characteristics, it is possible to achieve a small size of the recording head 1.

In addition, by opening the dummy supply path 19B on the bottom surface of the second recess portion 182, and by shortening the length, it is possible to reduce the flow path resistance of the dummy supply path 19B to be lower than the flow path resistance of the discharge supply path 19A. Therefore, when the suction-cleaning is performed by the suction operation from all of nozzle openings 21, in the flow path which passes through the supply path 19 to the nozzle opening 21 from the manifold 100, a flow amount of the flow path which passes through the dummy supply path 19B increases. Therefore, the bubbles incorporated in the ink on the inside of the manifold 100 are discharged via the dummy supply path 19B having a low flow path resistance. In addition, since the dummy supply path 19B is open on the bottom surface of the second recess portion 182, the ink supplied to the second manifold portion 18 from the first manifold portion 17 and the bubbles incorporated therein, are likely to reach the opening of the dummy supply path 19B without exceeding the inclined surface 183. In particular, when the pressure generation chamber 12 is disposed to be on the upper side in the vertical direction with respect to the second manifold 18, since the bubbles incorporated in the ink move to the upper side in the vertical direction by a buoyant force, it becomes difficult to move to the lower side in the vertical direction and exceed the inclined surface 183, and the bubbles are unlikely to reach the opening of the discharge supply path 19A. Therefore, as illustrated in FIG. 19, the bubbles 200 incorporated in the ink on the inside of the manifold 100 move in the first direction X along the inclined surface 183 on the bottom surface (the ceiling surface in the vertical direction) of the second recess portion 182, and are likely to reach the dummy supply path 19B which is open on the bottom surface of the second recess portion 182. Therefore, the bubbles 200 incorporated in the ink on the inside of the manifold 100 are easily discharged from the nozzle opening 21 via the dummy supply path 19B and the dummy pressure generation chamber 12B, and it is possible to improve the bubble discharge characteristics. In addition, since it is possible to prevent the bubbles 200 incorporated in the ink from being incorporated into the discharge pressure generation chamber 12A from the discharge supply path 19A, it is possible to prevent a discharge failure of the ink droplets as the bubbles 200 incorporated in the discharge pressure generation chamber 12A remain without being discharged. In addition, a case where the suction-cleaning is performed with respect to all of the nozzle openings 21 is described, but it is needless to say that the suction-cleaning may be performed only with respect to the nozzle opening 21 which communicates with the dummy pressure generation chamber 12B. In other words, even in a case where the suction-cleaning is performed only from the nozzle opening 21 which communicates with the dummy pressure generation chamber 12B, it is possible to efficiently discharge the bubbles of the ink from the dummy supply path 19B having a low flow path resistance. In addition, in the embodiment, the dummy supply paths 19B are provided in each of both end portions in the first direction X which is the arranging direction of the supply path 19. Therefore, it is possible to discharge the bubbles of both end portions in the first direction X in which the bubbles are likely to remain on the inside of the manifold 100 from the dummy supply path 19B, and to further prevent the bubbles from remaining.

Furthermore, since the inclined surface 183 is provided between the first recess portion 181 and the second recess portion 182, it is possible to make the angle portion made by the bottom surfaces of the inclined surface 183 and the second recess portion 182 an obtuse angle. Therefore, it is possible to improve the flow of the ink of the angle portion between the bottom surfaces of the inclined surface 183 and the second recess portion 182, and to prevent the bubbles from remaining in the angle portion.

In addition, in a configuration of Embodiment 3, by employing the inclined surface 183 similar to that of the above-described Embodiment 2, it is possible to make it easy to move the bubbles 200 further to the dummy supply path 19B side, and to improve the discharge characteristics of discharging the bubbles 200 via the dummy supply path 19B.

OTHER EMBODIMENTS

Above, each embodiment of the invention is described, but basic configurations of the invention are not limited to the description above.

For example, in the above-described Embodiments 2 and 3, the dummy supply path 19B is provided, but not being particularly limited thereto, for example, a discharge path which is open to the manifold 100 and open to the outside, may be additionally provided. In addition, the discharge path may configure a part of a circulating path which circulates the manifold 100 and a liquid storage unit, such as an ink tank. As the discharge path is disposed in the vicinity of the inclined surface 183, it is possible to efficiently move the bubbles 200 along the inclined surface 183, to discharge the bubbles 200 from the discharge path, and to improve the bubble discharge characteristics.

In addition, in each of the above-described embodiments, the inclined surface 183 is configured of the first inclined surface 183*a* and the second inclined surface 183*b* which have different angles, but not being particularly limited thereto, for example, the third inclined surface having different angle from those of the first inclined surface 183*a* and the second inclined surface 183*b* may be provided. In other words, the inclined surface 183 may have an inclined surface having three or more different angles when the inclined surface 183 has at least the first inclined surface 183*a* and the second inclined surface 183*b*.

Figure 24:
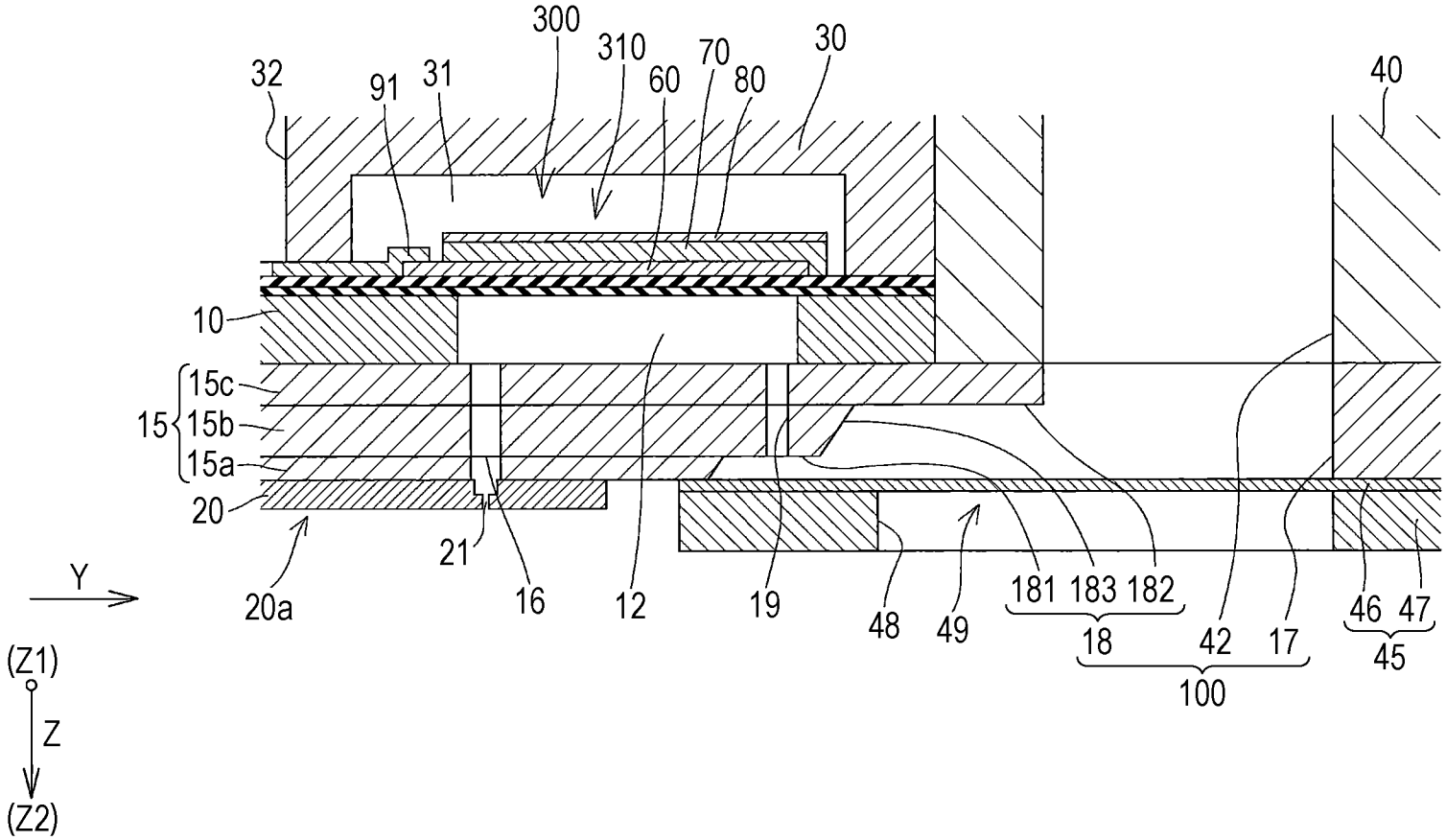
FIG. 24 is a sectional view in which main portions of a recording head according to another embodiment of the invention are enlarged.

Furthermore, in each of the above-described embodiments, as the communication plate 15, the silicon substrate in which the crystal plane orientation of the front surface is a {110} plane is used, and the second manifold portion 18 is formed by performing the anisotropic etching, but not being particularly limited thereto, for example, as the communication plate 15, a silicon substrate in which the crystal plane orientation is a {100} plane may be used, or an SOI substrate and a material, such as glass may be used. In addition, the forming method of the second manifold portion 18 is also not limited to the anisotropic etching, and for example, dry etching or mechanical processing may be employed. In addition, in each of the above-described embodiments, the communication plate 15 is one substrate, but not being particularly limited thereto, the communication plate 15 may be configured by layering a plurality of substrates. Such an example is illustrated in FIG. 24. In addition, FIG. 24 is a sectional view of the recording head according to another embodiment.

As illustrated in FIG. 24, the communication plate 15 is provided with a first communication plate 15*a*, a second communication plate 15*b*, and a third communication plate 15*c* which are layered in order toward the Z1 side from Z2 side in the third direction Z.

The first communication plate 15*a* is formed to have a thickness which is the same as the depth of the first recess portion 181. In addition, the second communication plate 15*b* forms the bottom surface of the first recess portion 181 on a surface on the Z2 side, and is formed to have a thickness which is the same as the depth of the second recess portion 182. In addition, the third communication plate 15*c* forms the bottom surface of the second recess portion 182 on a surface on the Z2 side. The first communication plate 15*a*, the second communication plate 15*b*, and the third communication plate 15*c* can be formed by adhering each other by an adhesive or the like, for example, after forming each of the first recess portion 181, the second recess portion 182, and the first manifold portion 17 by performing the anisotropic etching. In addition, the first communication plate 15*a*, the second communication plate 15*b*, and the third communication plate 15*c* may be layered after forming the communication path 16 and the supply path 19 in the first communication plate 15*a*, the second communication plate 15*b*, and the third communication plate 15*c*, and the communication path 16 and the supply path 19 may be formed after layering the first communication plate 15*a*, the second communication plate 15*b*, and the third communication plate 15*c*. In any case, in the third communication plate 15*c*, by forming the communication path 16 and the supply path 19 by performing the anisotropic etching from the same surface side, it is possible to prevent a relative position shift between the communication path 16 and the supply path 19, and to prevent unevenness of the ink discharge characteristics. However, compared to a case where the communication plate 15 is formed by layering the plurality of substrates, in a case of using the communication plate 15 made of one substrate similar to each of the above-described embodiments, it is possible to prevent the relative position shift of the first recess portion 181 and the second recess portion 182, and to form the first manifold portion 17, the second manifold 18, the communication path 16, the supply path 19 or the like, at high accuracy.

In addition, in the example illustrated in FIG. 24, the communication plate 15 is configured of three substrates, but the number is not particularly limited as long as the number of the layered substrates which configure the communication plate 15 is two or more. In addition, as illustrated in FIG. 24, by positioning a boundary of the layered substrates which configure the communication plate 15 according to the depth of the first recess portion 181 the second recess portion 182 or the like, it is possible to form the first recess portion 181, the second recess portion 182, the inclined surface 183 or the like at high accuracy. However, the boundary of the layered substrates is not particularly limited, and for example, the boundary of the layered substrates may be in the middle of the inclined surface 183.

In addition, in the example illustrated in FIG. 24, each of the communication path 16 and the supply path 19 is provided so that the opening areas throughout the first communication plate 15*a*, the second communication plate 15*b*, and the third communication plate 15*c* are the same, but not being particularly limited thereto, the opening areas of each of the communication path 16 and the supply path 19 of the first communication plate 15*a*, the second communication plate 15*b*, and the third communication plate 15*c*, may be formed to be the different.

In addition, in each of the above-described embodiments, a configuration in which the thin film-type piezoelectric actuator 300 is used as a pressure generation unit which generates a pressure change in the pressure generation chamber 12, is described, but not being particularly limited thereto, for example, it is possible to use a thick film-like piezoelectric actuator which is formed by a method of sticking a green sheet, or a longitudinal vibration-type piezoelectric actuator which layers a piezoelectric material and an electrode forming material alternately, and stretches and contracts the materials in the shaft direction. In addition, as the pressure generation unit, it is possible to use a unit which disposes a heat generation element on the inside of a pressure generation chamber, and discharges liquid droplets from the nozzle opening by the bubbles generated due to heat generation of the heat generation element, or a unit which generates static electricity between a vibration plate and an electrode, modifies the vibration plate by an electrostatic force, and discharges the liquid droplets from the nozzle opening, which is a so-called electrostatic actuator.

Figure 25:
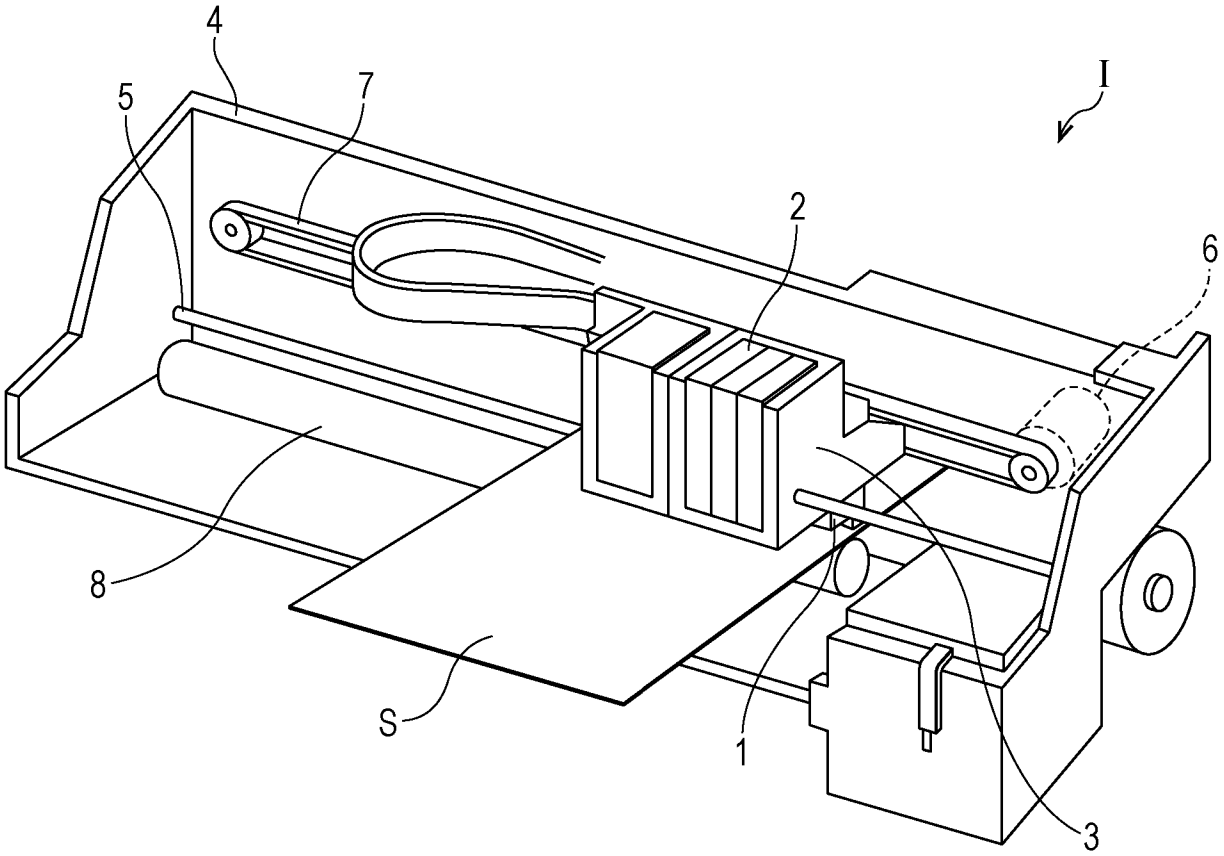
FIG. 25 is a schematic view of a recording device according to one embodiment of the invention.

The recording head 1 is mounted on an ink jet type recording device I. FIG. 25 is a schematic view illustrating an example of the ink jet type recording device of the embodiment.

In the ink jet type recording device I illustrated in FIG. 25, in the recording head 1, a cartridge 2 which configures a liquid supply unit is provided to be attachable and detachable, and a carriage 3 on which the recording head 1 is mounted is provided to freely move in the shaft direction to a carriage shaft 5 attached to a device main body 4.

In addition, as a driving force of the compressor lubricating oil 6 is transmitted to the carriage 3 via a plurality of gears which are not illustrated and a timing belt 7, the carriage 3 on which the recording head 1 is mounted moves along the carriage shaft 5. Meanwhile, a transporting roller 8 which serves as a transporting unit is provided in the device main body 4, and a recording sheet S which is a recording medium, such as a paper sheet, is transported by the transporting roller 8. In addition, the transporting unit which transports the recording sheet S may be a belt or a drum, not being limited to the transporting roller.

In addition, in the above-described example, the ink jet type recording device I has a configuration in which the cartridge 2 which is an ink supply unit is mounted on the carriage 3, but not being particularly limited thereto, for example, the liquid supply unit, such as an ink tank, may be fixed to the device main body 4, and the liquid supply unit and the recording head 1 may be connected to each other via a supply pipe, such as a tube. In addition, the liquid supply unit may not be mounted on the ink jet type recording device.

Furthermore, in the above-described ink jet type recording device I, an example in which the recording head 1 is mounted on the carriage 3 and moves in the main scanning direction, is illustrated, but not being particularly limited thereto, for example, the invention can also be employed in a so-called line type recording device which performs printing only by fixing the recording head 1 and by moving the recording sheet S, such as a paper sheet, in the sub-scanning direction.

In addition, a target of the invention is a widely general liquid ejecting head, and for example, the invention can also be employed in the recording head, such as various types of ink jet type recording head which is used in an image recording device, such as a printer; a color material ejecting head which is used in manufacturing a color filter, such as a liquid crystal display; an electrode material ejecting head which is used in forming an electrode, such as an organic EL display or an FED (field emission display); and a bio-organic ejecting head which is used in manufacturing a bio chip. In addition, as an example of the liquid ejecting apparatus, the ink jet type recording device I is described, but the invention can also be used in the liquid ejecting apparatus in which other liquid ejecting heads described above are used.

The entire disclosure of Japanese Patent Application No. 2016-016284, filed Jan. 29, 2016 is expressly incorporated by reference herein in its entirety.

What is claimed is:

1. A liquid ejecting head comprising:

a flow path forming substrate in which an individual flow path of a plurality of individual flowpaths is formed, wherein the individual flow path communicates with a nozzle opening that discharges liquid, the flow path forming substrate including a pressure generation chamber; and a communication plate in which a recess portion which configures at least a part of a common flow path that is common to and communicates with the plurality of individual flow paths is provided to be open on a side opposite to the flow path forming substrate, wherein the recess portion includes a first recess portion and a second recess portion which is deeper than the first recess portion and less deep than the communication plate, wherein the communication plate includes:

a supply path which extends completely through the communication plate, is provided to be open on a bottom surface of the first recess portion, communicates with the recess portion and the individual flow path, and becomes a throttle portion that throttles a flow path with respect to the individual flow path, and a communication path which communicates with the individual flow path and the nozzle opening, and wherein, in the individual flow path, a throttle portion which throttles the individual flow path from a part that communicates with the supply path to a part that communicates with the communication path, is not provided in the pressure generation chamber of the flow path forming substrate such that the width and depth of the pressure generation chamber are substantially constant along the length of the pressure generation chamber.

2. The liquid ejecting head according to claim 1, wherein the supply path extends completely through the bottom surface of the first recess portion.

3. The liquid ejecting head according to claim 1, wherein the communication path extends completely through the communication plate.

4. The liquid ejecting head according to claim 1, wherein the communication path and the supply path are formed by performing anisotropic etching from one surface side of the communication plate.

5. The liquid ejecting head according to claim 1, wherein the communication plate is made of one substrate.

6. The liquid ejecting head according to claim 1, wherein the communication plate is made by layering a plurality of substrates.

7. The liquid ejecting head according to claim 1, wherein an inclined surface, Which is inclined toward a bottom surface of the second recess portion from the bottom surface of the first recess portion, is formed between the first recess portion and the second recess portion.

8. The liquid ejecting head according to claim 1, wherein the communication plate is a silicon substrate which becomes a plane in which a crystal plane orientation of a front surface is a {110} plane, and wherein the bottom surface of the first recess portion and a bottom surface of the second recess portion are formed of a plane in which a crystal plane orientation is a {110} plane.

9. A liquid ejecting apparatus comprising:

the liquid ejecting head according to claim 1.

10. A liquid ejecting apparatus comprising:

the liquid ejecting head according to claim 4.

11. A liquid ejecting apparatus comprising:

the liquid ejecting head according to claim 5.

12. A liquid ejecting apparatus comprising:

the liquid ejecting head according to claim 6.

13. A liquid ejecting apparatus comprising:

the liquid ejecting head according to claim 5.

14. A liquid ejecting apparatus comprising:

the liquid ejecting head according to claim 8.

15. A manufacturing method of a liquid ejecting head which includes a flow path forming substrate in which an individual flow path of a plurality of individual flow paths is formed, wherein the individual flow path communicates with a nozzle opening that discharges liquid, the flow path terming substrate including a pressure generation chamber; and a communication plate in which a recess portion which configures at least a part of a common flow path that is common to and communicates with the plurality of individual flow paths is provided to be open on a side opposite to the flow path forming substrate, in which the recess portion includes a first recess portion and a second recess portion which is deeper than the first recess portion and less deep than the communication plate, in which the communication plate includes: a supply path which extends completely through the communication plate, is provided to be open on a bottom surface of the first recess portion, communicates with the recess portion and the individual flow path, and becomes a throttle portion that throttles a flow path with respect to the individual flow path, and a communication path which communicates with the individual flow path and the nozzle opening, and in which, in the individual flow path, a throttle portion Which throttles the individual flow path from a part that communicates with the supply path to a part that communicates with the communication path, is not provided in the pressure generation chamber of the flow path forming substrate such that the width and depth of the pressure generation chamber are substantially constant along the length of the pressure generation chamber, the method comprising:

forming the communication path and the supply path by performing anisotropic etching from one surface side which is opposite to a surface on which the recess portion of the communication plate is open.

16. The manufacturing method of a liquid ejecting head according to claim 15, wherein the same mask is used in forming the communication path and the supply path on the communication plate.

17. The manufacturing method of a liquid ejecting head according to claim 15, wherein the supply path extends completely through the bottom surface of the first recess portion.

18. The manufacturing method of a liquid ejecting head according to claim 15, wherein the communication path extends completely through the communication plate.

* * * * *